US005969713A

United States Patent [19]

Tomizawa et al.

[11] Patent Number: 5,969,713

[45] Date of Patent: Oct. 19, 1999

[54] DRIVE CIRCUIT FOR A MATRIX-TYPE DISPLAY APPARATUS

[75] Inventors: Kazunari Tomizawa; Takaji Numao, both of Kashiwa, Japan

[73] Assignees: Sharp Kabushiki Kaisha, Osaka, Japan; The Secretary of State for Defence in Her Britannic Majesty's Government of the United Kingdom of Great Britain and Northern Ireland, United Kingdom

[21] Appl. No.: 08/764,844

[22] Filed: Dec. 13, 1996

[30] Foreign Application Priority Data

Dec. 27, 1995 [JP] Japan ..... 7-341876

[51] Int. Cl.[6] ..... G09G 5/00

[52] U.S. Cl. ..... 345/198; 345/100; 345/98; 345/197

[58] Field of Search ..... 345/98, 99, 100, 345/197, 198

[56] References Cited

U.S. PATENT DOCUMENTS

| | | | |
|---|---|---|---|
| 5,248,963 | 9/1993 | Yasui et al. | 345/98 |
| 5,442,372 | 8/1995 | Shiki | 345/98 |
| 5,461,424 | 10/1995 | Shimizu | 348/443 |
| 5,510,805 | 4/1996 | Lee | 345/58 |
| 5,526,013 | 6/1996 | Ono et al. | 345/94 |
| 5,526,014 | 6/1996 | Shiba et al. | 345/96 |
| 5,534,885 | 7/1996 | Saitoh | 345/100 |
| 5,563,624 | 10/1996 | Imamura | 345/100 |
| 5,801,672 | 9/1998 | Masuda et al. | 345/98 |

FOREIGN PATENT DOCUMENTS

| | | |
|---|---|---|
| 0607778 | 7/1994 | European Pat. Off. . |
| 63-226178 | 9/1988 | Japan . |
| 2253232 | 10/1990 | Japan . |
| 5107521 | 4/1993 | Japan . |
| 6043829 | 2/1994 | Japan . |

OTHER PUBLICATIONS

P.W. H., Surguy et al., Ferroelectrics, 1991, vol. 122, pp. 63–79 "The "Joers/Alvey" Ferroelectric Multiplexing Scheme".

P.W., Ross et al., SID 92 Digest, 1992, pp. 217–220 "Color Ferroelectic LCDs for Laptop Applications".

J.R. Hughes et al., Liquid Crystals, 1993, vol. 13, No. 4, pp. 597–601 "A New Set of High Speed Matrix Addressing Schemes for Ferroelectric Liquid Crystal Displays".

*Primary Examiner*—Richard A. Hjerpe
*Assistant Examiner*—Henry N. Tran

[57] ABSTRACT

The drive circuit for a matrix-type display apparatus is a scanning driver for selecting one scanning electrode respectively for four selection periods, and displaying data of each bit for four bits in a pixel on the selected electrode. The scanning driver has four shift registers corresponding to four selection periods. To these shift registers, a clock having the width of four selection periods and a bit data indicating each bit are inputted. By the AND circuit, etc., a logical product of 15 shift signals from the shift register and four select signals is obtained, and using a signal of sum (logical OR) of the logical product, the ON/OFF of a selection voltage output switch and a non-selection voltage output switch is controlled. As a result, a drive circuit suited for the multiplex driving method can be achieved.

22 Claims, 22 Drawing Sheets

1 2 3 4 5 6 7 8 9 0 1 2 3 4 5 6 7 8 9 0 1 2 3 4 5 6 7 8 9 0

1 2 3 4 5 6 7 8 9 0 1 2 3 4 5 6 7 8 9 0 1 2 3 4 5 6 7 8 9 0

1 2 3 4 5 6 7 8 9 0 1 2 3 4 5 6 7 8 9 0 1 2 3 4 5 6 7 8 9 0

2
2a
2b
L1
XSW1
YSW1
ZSW1
Vc2
Vc0
Vc1
701b
701b'
701c
701a
701
SVS1
SVB1
501
501'
ASS1
BSS1,CSS1,DSS1
ASB1
BSB1, CSB1, DSB1
101
102
115
101'
102'
115'
BL1
SEL1
ASR1
ASR2
ASR15
ABR1
ABR2
ABR15
SELECTION-USE SHIFT REGISTER
1st bit
11a
ERASE-USE SHIFT REGISTER
1st bit
11b
21
IN
Q
CK
SDAT1
BDAT1

FIG. 19 (a) PRIOR ART
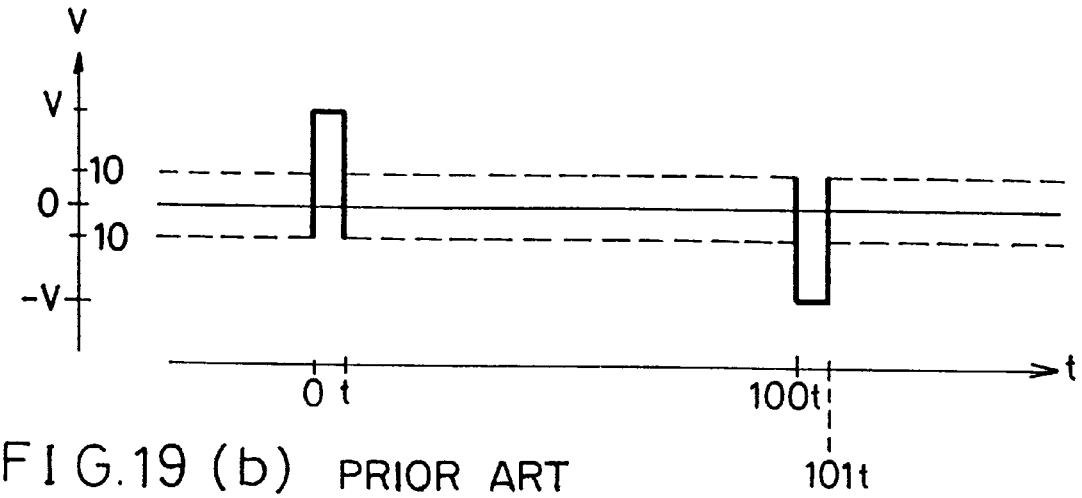
FIG. 19 (b) PRIOR ART
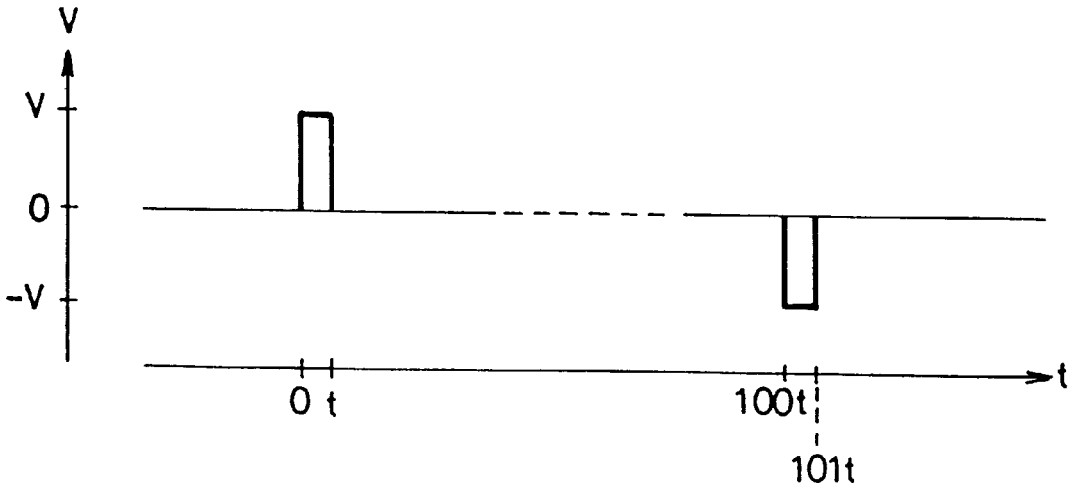

DRIVE CIRCUIT FOR A MATRIX-TYPE DISPLAY APPARATUS

FIELD OF THE INVENTION

The present invention relates to a drive circuit for driving a display panel in a matrix-type display apparatus having a memory effect, such as a ferroelectric liquid crystal display apparatus, etc.

BACKGROUND OF THE INVENTION

Matrix-type display apparatuses with a memory effect include not only phase transition liquid crystal display apparatuses as disclosed in Japanese Unexamined Patent Application No. 107521/1993 (Tokukaihei 5-107521), but also ferroelectric liquid crystal display apparatuses as disclosed in Japanese Unexamined Patent Application No. 20715/1991 (Tokukaihei 3-20715), plasma display apparatuses as disclosed in Japanese Unexamined Patent Application No. 43829/1994 (Tokukaihei 6-43829), etc.

In general, the matrix-type display apparatuses have such characteristics that a selection period is required independently for each scanning electrode, which makes it impossible to select a plurality of scanning electrodes at one time. In each of the described matrix-type display apparatuses, a display is performed by varying a voltage to be applied to the scanning electrode. Specifically, a selection voltage for determining a display state of a pixel is applied, and then a holding voltage for holding the selected display state of the pixel is applied. Lastly, an erase voltage is applied to erase the display state of the pixel. The display state of the pixel can be erased also by stopping the application of the holding voltage.

In the described display apparatuses, a gray shades display is enabled, for example, by the scanning method disclosed in Japanese Unexamined Patent Application No. 226178/1988 (Tokukaisho 63-226178). The scanning method will be explained in reference to FIG. 14.

FIG. 14 is a typical depiction of a scanning method for the matrix-type display apparatus including fifteen scanning electrodes $L_1$–$L_{15}$, wherein the scanning electrodes $L_1$–$L_{15}$ are selected in order according to the numbers 1–60 indicative of selection periods assigned to the top line. In respective blocks, bit numbers of data to be applied to pixels on the scanning electrodes $L_1$–$L_{15}$ are assigned.

In this example, each bit of 4-bit data is applied to each pixel on the scanning electrode $L_i$ specified with an application of a selection voltage in each selection period. As a result, in each of the first through fourth selection periods, a pixel on the scanning electrode $L_{15}$ displays the fourth bit, the pixel on the scanning electrode $L_1$ displays the first bit, the pixel on the scanning electrode $L_3$ displays the second bit, and the pixel on the scanning electrode $L_7$ displays the third bit.

In FIG. 14, a non-selection voltage is applied to the scanning electrode $L_i$ to which the bit number is not assigned in each selection period.

As described, in the scanning method, a gray shades display is enabled by performing a scanning operation with a multiplex driving.

Here, a general arrangement of the ferroelectric liquid crystal display apparatus (hereinafter referred to as FLCD) to which the described scanning method is applied will be explained. The FLCD has a liquid crystal panel 61 as shown in FIG. 15. The liquid crystal panel 61 includes substrates 62 and 63 which face each other. The substrates 62 and 63 are made of a light-transmissive material such as glass, etc.

On the surface of the substrate 62, a plurality of transparent signal electrodes S made of, for example, indium tin oxide (hereinafter referred to as ITO) are placed in parallel. The signal electrodes S are coated with a transparent insulating film 64 made of, for example, silicone oxide ($SiO_2$).

On the surface of the substrate 63, a plurality of transparent scanning electrodes L made of, for example, ITO, etc., are placed in parallel. These transparent scanning electrodes L are placed so as to cross the signal electrodes S at right angle. These scanning electrodes L are coated with a transparent insulating film 65 made of the same material as the insulating film 64.

On the insulating film 64 and 65, alignment films 66 and 67, to which uniaxial alignment process such as rubbing process, etc., is applied, are formed. For the alignment films 66 and 67, a polyvinyl alcohol, etc., is used.

The ferroelectric liquid crystals 68 are filled in a space formed between the glass substrates 62 and 63 which are laminated by a sealing agent 69 in such a manner that the alignment films 66 and 67 face each other, thereby forming a liquid crystal layer. The ferroelectric liquid crystals 68 are poured through an opening (not shown) formed in the sealing agent 69, and are sealed by closing the opening.

The substrates 62 and 63 are further sandwiched by two polarized plates 70 and 71 placed in such a manner that respective planes of polarization cross at right angle.

As shown in FIG. 16, the scanning electrode L ($L_o$ through $L_F$) are connected to the scanning driver 81, and the signal electrodes S ($S_o$ through $S_F$) are connected to the signal driver 82.

In the scanning driver 81, a one-bit scanning signal YI is transferred by the shift register 81*a* based on a clock CK, and is outputted from each output stage of the shift register 81*a*. The analog switch array 81*b* selects whether the selection voltage $V_{c1}$ is to be applied to the scanning electrode $L_i$, or the non-selection voltage $V_{c0}$ is to be applied to the scanning electrode $L_k$ ($k \neq i$) depending on whether the signal outputted from the shift register 81*a* is in the High level or the Low level.

In the signal driver 82, the data signal XI is transferred by the shift register 82*a* based on the clock CK, and is outputted from each output stage of the shift register 82*a*. The output signal from the shift register 82*a* is held by a latch 82*b* in sync with a negative latch pulse LP. The analog switch array 82*c* selects whether an active voltage $V_{S1}$ is to be applied to the signal electrode $S_j$, or a non-active voltage $V_{S0}$ is to be applied to the signal electrode $S_k$ ($k \neq j$) depending on whether the value held by the latch 82*b* is in the High level or the Low level.

In the FLCD having the described arrangement, a pixel is formed at a portion where the scanning electrode L and the signal electrode S cross. Then, by turning ON/OFF the lightening of each pixel, a display is performed on the entire liquid crystal panel 61.

As shown in FIG. 17(*b*), the liquid crystal molecules 91 in the pixel has a voluntary polarization $P_S$ in a direction perpendicular to the major axis direction. The liquid crystal molecules 91 move on the surface of a circular cone 92 having a vertical angle $2\theta$ of twice as large as the tilt angle by receiving a force in proportion to a vector product of an electric field E generated by a potential difference between the application voltage to the scanning electrode L and the application voltage to the signal electrode S, and the voluntary polarization $P_S$.

As shown in FIG. 17(*a*), when the liquid crystal molecules 91 are moved to an axis 93 by the electric field E, the liquid crystal molecules 91 become stable at position $P_1$. When the liquid crystal molecules 91 are further moved to an axis 94 by the electric field E, and the liquid crystal molecules 91 become stable at position $P_2$. Namely, the liquid crystal molecules 91 have the described two stable states.

Even if the liquid crystal molecules 91 are further moved by the electric field E, as long as the positions $P_1$ and $P_2$ do not vary, a restoring force is exerted onto the liquid crystal molecules 91 to move them back to the original stable state.

Here, by making a plane of polarization of either one of the polarization plates 70 and 71 shown in FIG. 15 to coincide with either one of the axes 93 and 94, two display states can be achieved. Specifically, the pixel having the liquid crystal molecules 91 in one stable state is in a bright display state, while the pixel having the liquid crystal molecules 91 in the other stable state is in the dark display state.

Not only the force generated by the electric field E but also a force in proportion to a product of a dielectric anisotropy $\Delta\epsilon$ indicative of a difference in dielectric constant between the major axis direction and the minor axis direction of the molecule and the second power of the electric field E are exerted onto the liquid crystal molecules 91. Thus, the force exerted onto the liquid crystal molecules 91 is shown by the following formula:

$$F=K_0\times P_S\times E+K_1\times\Delta\epsilon\times E^2,$$

wherein $K_0$ and $K_1$ are constants.

For this reason, in the liquid crystal panel 61 in which an FLC material having a negative dielectric anisotropy $\Delta\epsilon$ is sealed, when the electric field E is increased to a predetermined electric field $E_{min}$, an increase in force by the negative dielectric anisotropy $\Delta\epsilon$ becomes greater than an increase in force by the spontaneous polarization $P_S$ under an applied electric field $E_{min}$, the force exerted onto the liquid crystal molecules 91 is maximized under the applied electric field $E_{min}$. On the other hand, as a memory pulse width is known to be in reverse proportion to the force exerted onto the liquid crystal molecules 91, the memory pulse width is minimized under an applied electric field $E_{min}$.

As the driving method for the FLCD utilizing the described characteristics, for example, JOERS/Alvey drive scheme (hereinafter referred to as a J/A drive scheme) is reported in "The JOERS/Alvey Ferroelectric Multiplexing Scheme" (Ferroelectrics, 1991, Vol. 122, pp.63–79) presented by Defense Research Agency in the FLC international conference (1991). The characteristics of voltage vs memory pulse width of the SCE 8 that is a FLC material available from BDH Ltd. described in the paper are shown in FIG. 18.

The circled data in FIG. 18 were measured while superimposing thereon a bias voltage of ±10 V shown in FIG. 19(*a*). On the other hand, in FIG. 18, the data marked "+" were measured while superimposing thereon a bias voltage of ±0 V shown in FIG. 19(*b*).

In the described driving method, the data in one screen is rewritten by scanning two fields. In the first field, as shown in FIG. 20(*a*), a voltage $V_{SC}$ is applied to the signal electrode $S_j$ when the selection voltage $V_{CA}$ is applied to the scanning electrode $L_i$, thereby applying a voltage $V_{A\text{-}C}$ to the liquid crystal molecules 91 in the pixel at which the scanning electrode $L_i$ and the signal electrode $S_j$ cross each other. As a result, the liquid crystal molecules 91 can be switched to one stable state.

In the second field, as shown in FIG. 20(*b*), a voltage $V_{SH}$ is applied to the signal electrode $S_j$ when the selection voltage $V_{CE}$ is applied to the scanning electrode $L_i$, thereby applying a voltage $V_{E\text{-}H}$ to the liquid crystal molecules 91 in the pixel at which the scanning electrode $L_i$ and the signal electrode $S_j$ cross each other. As a result, the liquid crystal molecules 91 are kept in the current stable state.

In the case of switching the stable state of the liquid crystal molecules 91 to the other stable state, first, in the first field, as shown in FIG. 20(*a*), a voltage $V_{SG}$ is applied to the signal electrode $S_j$ so as to applying the voltage $V_{A\text{-}G}$ to the liquid crystal molecule 91 in the pixel when the selection voltage $V_{CA}$ is applied to the scanning electrode $L_i$. As a result, the stable state of the liquid crystal molecules 91 does not vary.

In the second field, as shown in FIG. 20(*b*), the voltage $V_{SD}$ is applied to the signal electrode $S_j$ when the selection volntage $V_{CE}$ is applied to the signal electrode $S_i$, so as to apply the voltage $V_{E\text{-}D}$ to the liquid crystal molecule 91. As a result, the liquid crystal molecules 91 are switched from one stable state to the other stable state.

While the liquid crystal molecules 91 in other pixel are being switched from one stable state to the other stable state, the voltage is applied in the following manner.

As shown in FIG. 20(*a*), in the first field, the non-selection voltage $V_{CB}$ is applied to the scanning electrode $L_k$ ($k\neq i$) when the voltage $V_{SC}$ or the voltage $V_{SG}$ is applied to the signal electrode $S_j$, thereby applying the voltage $V_{B\text{-}C}$ or the voltage $V_{B\text{-}G}$ to the liquid crystal molecules 91 in the pixel at which the scanning electrode $L_k$ and the signal electrode $S_j$ cross each other. As shown in FIG. 20(*b*), in the second field, the non-selection voltage $V_{CF}$ is applied to the scanning electrode $L_k$ when the voltage $V_{SD}$ or the voltage $V_{SH}$ is applied to the signal electrode $S_j$, thereby applying the voltage $V_{F\text{-}D}$ or the voltage $V_{F\text{-}H}$ to the liquid crystal molecules 91 in the pixel at which the scanning electrode $L_k$ and the signal electrode $S_j$ cross each other. As a result, the stable state of the liquid crystal molecules 91 does not vary irrespectively of the applied voltage to the signal electrode $S_j$.

The described driving method is applicable when the following conditions are satisfied:

Condition 1: Absolute values of the voltage levels $-V_s+Vd$ and $V_s-V_d$ which respectively determine the voltages $V_{A\text{-}C}$ and $V_{E\text{-}D}$ shown in FIGS. 20(*a*) (*b*) indicate voltages of around 40 (V) in the characteristic diagram shown in FIG. 18 at which the force exerted onto the liquid crystal molecules 91 is in a vicinity of the maximum value; and Condition 2: Absolute values of the voltage levels $-V_s-V_d$ and $V_s+V_d$ which respectively determine the voltages $V_{A\text{-}G}$ and $V_{E\text{-}H}$ shown in FIGS. 20(*a*) (*b*) are voltages of around 60 (V) in the characteristic diagram shown in FIG. 18 at which the force exerted onto the liquid crystal molecules 91 reduces from the maximum value.

Thus, the force exerted onto the liquid crystal molecules 91 with an application of voltage under the condition 1 becomes larger than the force exerted onto the liquid crystal molecule 91 with an application of voltage under the condition 2.

In order to apply the described driving method, the following conditions are also required:

The voltage $V_{A\text{-}C}$ takes two levels $-V_d$ and $-V_s+V_d$ which are of the same polarity, and the voltage $V_{E\text{-}D}$ takes two voltage levels $V_d$ and $V_s-V_d$ which are of the same polarity. On the other hand, the voltage $V_{A\text{-}G}$ takes two voltage levels $V_d$ and $-V_s-V_d$ which are of opposite polarities, and the voltage $V_{E\text{-}H}$ takes two voltage levels $-V_d$ and $V_s+V_d$ which are of opposite polarities. In the case of the same polarity, voltage levels $-V_S+V_d$ and $V_s-V_d$ which are easy to switch the stable state are selected. On the other hand, in the case of opposite polarities, voltage levels $-V_s-V_d$ and $V_s+V_d$ which are not easy to switch the stable state as compared to the case of the same polarity are selected.

The J/A drive scheme has been developed, for example, as a Malvern drive scheme that is disclosed in "A new set of high matrix addressing schemes for ferroelectric liquid crystal displays" (Liquid Crystals, Vo.13, No.4, 1993, 597–601). As shown in FIG. 21, in the J/A drive scheme (J/A in the figure), the selection voltage in the row voltage waveform is selected to have the same duration as a time slot T, while in the Malvern-2 and the Malvern-3 drive schemes respectively denoted by (M-2) and (M-3) in the figure, the selection voltages are selected to have durations of 2 times and 3 times of that of the time slot T respectively.

In the case of the FLCD as an example of the matrix-type liquid display apparatus, in the J/A drive scheme, drive voltages respectively having waveforms shown in FIGS. 20(*a*) and (*b*) are applied in the scanning of two fields required for rewriting the data of one screen, while in the drive scheme disclosed in "Color Digital Ferroelectric Liquid Crystal Displays For Laptop Applications" in SID '92, as shown in FIG. 22, by adopting an erase voltage (blanking pulse BP), the data in one screen is rewritten only in the second field.

However, in the described scanning method, the scanning electrode $L_i$ is selected in a discrete manner such as $L_{15}\rightarrow L_1\rightarrow L_3\rightarrow L_7$. In case of scanning with the existing driver IC, problems arise in that a complicated input signal (clock, data pulse, etc.) is required, more than necessary driver IC are required, etc. For this reason, in the drive circuit constituted by the existing driver IC, it is difficult to perform a multiplex gray shades display by the described scanning method.

The multiplex gray shades display is difficult to be performed with the existing driver IC also in the case where the selection voltage is held longer than the selection period like the Malvern-2 and the Malvern-3 drive schemes as shown in FIG. 21. Specifically, for example, when the selection voltage to be applied to the scanning electrode $L_1$ is held longer than the selection period, the selection voltage of the scanning electrode $L_1$ also affects the scanning electrode $L_3$ to be scanned next. As a result, not only the selection voltage to be originally applied to the scanning electrode $L_3$ but also the selection voltage being applied over the selection period for the scanning electrode $L_1$ are applied to the scanning electrode $L_3$.

Furthermore, the multiplex gray shades display is difficult to be performed also in the case of scanning shown in FIG. 22 in combination with an erase voltage. Specifically, in such scanning method both the selection voltage and the erase voltage are output ted in the same selection period (see FIG. 6); however, with the existing driver IC, it is difficult to output two signals simultaneously.

SUMMARY OF THE INVENTION

The present invention is achieved in the hope of finding a solution to the above-mentioned problems, and accordingly, the first object of the present invention is to provide a drive circuit suited for a multiplex driving method in a matrix-type display apparatus, the second object of the present invention is to provide a drive circuit suited for a scanning method in combination with an erase voltage, and the third object of the present invention is to provide a drive circuit suited for such scanning method that a selection voltage is held longer than a selection period.

In order to achieve the above object, the first drive circuit of the matrix-type display apparatus of the present invention is characterized by adopting the following structures.

First Drive Circuit

The first drive circuit includes n shift registers for outputting shift signals in the same number as scanning electrodes by shifting a data signal having a width of n selection periods (n is an integer of not less than 2) in sync with a clock having a frequency of n selection periods; first logical product output means (AND circuit) for obtaining a logical AND of the shift signal and one of n select signals having a constant period for determining a selection voltage application period, the first logical product output means being provided in the same number as the shift signals for each of the n shift registers; and first logical sum output means (OR circuit) for obtaining a logical OR of logical ANDs based on shift signals which are in the same order of output respectively from the n shift registers. The clock and select signals are inputted in phase shifted respectively by one selection period for each shift register.

In the scanning pattern shown in FIG. 14, it appears that the respective scanning electrodes $L_i$ are selected in a discrete manner as described earlier. However, when seen from respective first through fourth bits, the scanning electrodes $L_i$ are selected in a predetermined pattern for each bit in order from a smaller scanning electrode $L_i$ such as $L_1$, $L_2$, $L_3$, . . .

The first drive circuit follows the described pattern.

In the first drive circuit, an inputted data signal is shifted in order by the n shift registers, and is outputted in a form of a plurality of shift signals. Specifically, from the 1st through nth shift registers, shift signals $SR(\mathbf{1})_1$, $SR(\mathbf{2})_1$, $SR(\mathbf{3})_1$, . . . , $SR(\mathbf{1})_2$, $SR(\mathbf{2})_2$, $SR(\mathbf{3})_2$, . . . , $SR(\mathbf{1})_n$, $SR(\mathbf{2})_n$, $SR(\mathbf{3})_n$ respectively corresponding to the scanning electrodes $L_1$, $L_2$, $L_3$, . . . , are outputted.

Then, by the first logical product output means, a logical AND of these shift signals and select signals is obtained. Further, by the first logical sum output means, a logical OR of the logical ANDs based on the shift signals in the same order of output from respective shift registers is obtained. Namely, the logical OR to the scanning electrode $L_i$ is shown by the following formula:

$$(SR(i)_1\times SEL_1)+(SR(i)_2\times SEL_2)+\ldots+(SR(i)_n\times SEL_n) \quad (1),$$

wherein $SEL_1$ through $SEL_n$ are select signals, "x" is a logical AND, and "+" is a logical OR.

As a result, a signal that is shifted in order of the scanning electrodes $L_1$, $L_2$, $L_3$ . . . is generated at every n selection periods. Thus, when carrying out a multiplex gray shades display by selecting scanning electrodes for each bit of the n-bit data, by preparing shift registers and select signals for each bit, a selection voltage can be applied to the scanning electrodes in order from $L_1$, $L_2$, $L_3$, . . . at every four selection period as in the scanning method by the scanning pattern shown in FIG. 14, thereby permitting a multiplex gray shades display by a simple input signal.

A clock and a select signal to be inputted to respective shift registers are shifted by a selection period. As a result, such problem that respective selections of scanning electrodes for each bit are overlapped can be prevented. Moreover, the gray shades level is determined based on the timing of the data signal to be inputted to each shift register.

Second Drive Circuit

The second drive circuit having the structure of the first drive circuit includes second logical product output means (AND circuit) for obtaining a logical AND of one of n blank signals having a constant period for determining an erase voltage application period and the shift signal, the second logical product output means being provided in the same number as the shift signals for each shift register; and second logical sum output means (OR circuit) for obtaining a logical OR of logical ANDs obtained from the second logical product output means based on shift signals which are in the same order of output respectively from the n shift registers. In the second drive circuit, the blank signals are inputted in phase shifted by one selection period for each shift register in such a manner that a significant period thereof is not overlapped with that of the n select signals.

Like the FLCD, in the matrix-type display apparatus having a memory effect, it is required to apply an erase voltage before applying a selection voltage. In the seapplication peruit, the application period of the erase voltage is set utilizing the characteristics of the first drive circuit that the shift signal to be outputted from each shift register has a width of the n selection periods.

Specifically, in the second drive circuit, by the second logical product output means, a logical product of the shift signal outputted from respective shift registers and the blank signal is obtained. Furthermore, by the second logical sum output means, a logical OR of the logical ANDs based on the shift signals in the same order of output from respective shift registers is obtained. Namely, the logical OR of the scanning electrode $L_i$ is defined by the following formula:

$$(SR(i)_1 \times BL_1)+(SR(i)_2 \times BL_2)+\ldots+(SR(i)_n \times BL_n) \quad (2),$$

wherein $BL_1$ through $BL_n$ are blank signals.

As a result, a signal that is shifted in order of the scanning electrodes $L_1$, $L_2$, $L_3$ . . . is generated at every n selection periods. Thus, when carrying out multiplex gray shades display by the described manner, by preparing blank signals for each bit, an erase voltage can be applied to the scanning electrodes in order from $L_1$, $L_2$, $L_3$, . . . at every four selection periods as in the scanning pattern shown in FIG. 6, thereby permitting a complicated n-bit multiplex gray shades display including an erase voltage based on an input signal of a simple waveform.

Moreover, as respective effective periods of the select signal and the blank signal are not overlapped, it is permitted to apply the selection voltage after the erase voltage is applied. Furthermore, as the blank signal is inputted in phase shifted by one selection period for each shift register, the erase voltage can be applied to the scanning electrodes for each bit without being overlapped.

Additionally, by increasing the number of select signals and blank signals, the kind of selection voltages and the erase voltages can be increased. However, it is not preferable to adopt the selection voltage that are applied to a plurality of scanning electrodes at one time. Therefore, for the selection voltage, it is required to set a select signal such that a plurality of potentials are generated within one selection period.

Third Drive Circuit

The third drive circuit includes n selection shift registers for outputting selection shift signals in the same number as scanning electrodes by shifting selection data signals having a width of n selection periods (n is an integer of not less than 2) in sync with a clock having a period of n selection periods;

n erase shift registers for outputting erase shift signals obtained by shifting the erase data signals indicative of information different from that of the selection data signals in the same manner as the selection shift register, the erase data signals having the same width as the selection data signals; first logical product output means (AND circuit) for obtaining a logical AND of one of n select signals having a constant period for determining a selection voltage application period and the selection shift signals, the first logical product output means being provided in the same number as the selection shift signals for each pair of the selection shift register and the erase shift register; second logical product output means (AND circuit) for obtaining a logical AND of one of n blank signals having a constant period for determining an erase voltage application period and the erase shift signals, the second logical product output means being provided in the same number as the erase shift signals for each pair of the selection shift register and the erase shift register; first logical sum output means (OR circuit) for obtaining a logical OR of logical ANDs obtained from the first logical product output means based on selection shift signals which are in the same order of output respectively from the n selection shift registers; and second logical sum output means (OR circuit) for obtaining a logical OR of logical ANDs obtained from the second logical product output means based on erase shift signals which are in the same order of output respectively from the n erase shift registers. In the third drive circuit, the n blank signals are inputted in such a manner that the significant period thereof is not overlapped with that of the n select signals, and the clock, the n select signals and the n blank signals are inputted in phase shifted by one selection period for each pair of the selection shift register and the erase shift register.

By the described arrangement, the third drive circuit permits a control signal for controlling an application of a selection voltage and a control signal for controlling an application of an erase voltage to be outputted independently. For this purpose, the third drive circuit has selection-use shift registers and erase-use shift registers in pairs.

In the described drive circuit, the selective-use data signal is shifted by the n selective-use shift registers in order and is outputted as a plurality of selective shift signals. The erase-use data signal is shifted in order by n erase-use shift registers, and is outputted as a plurality of erase-use shift signals. As a result, from the 1st through nth shift registers, two kinds of shift signals are obtained as in the second drive circuit.

By the first logical product output means, a logical AND of the select signal to be inputted in response to each selective-use shift register and the selective-use shift signal is obtained. Further, by the second logical product output means, a logical AND of the blank signal which is inputted in response to each erase-use shift register and the erase-use shift signal is obtained.

Furthermore, by the first logical sum output means, a logical OR of the logical ANDs from the first logical product output means based on the selective-use shift signals which are in the same order of output from the selective-use shift registers in accordance with the formula (1) is obtained. On the other hand, by the second logical sum output means, a logical OR of the logical ANDs from the second logical product output means based on the erase-use shift signals which are in the same order of output from the erase-use shift register is obtained in accordance with the formula (2).

As a result, signals of two kinds which are shifted in order of the scanning electrodes $L_1$, $L_2$, $L_3$, . . . at every n selection periods are generated. Thus, the described third drive circuit permits the selection voltage and the erase voltage to be applied to the scanning electrodes in order at every four selection periods using the described signals as in the second drive circuit.

In the third drive circuit, a logical calculation in common with the first and second drive circuits is performed. However, the third drive circuit differs from the first and second drive circuit in that a selection-use shift register and an erase-use shift register are independently provided. This permits the selective-use shift signal and the erase-use shift signal to be obtained respectively based on the independent selective-use data signal and the erase-use data signal. Thus, by setting the timing of the selective-use data signal and the erase-use data signal, an interval between the selection voltage and the erase voltage can be set as desired, thereby permitting multiplex gray shades display with a high degree of freedom.

In the second drive circuit, an interval between the erase voltage and the selection voltage is limited by the number of bits used in the multiplex gray shades display. For example, in the case of 4-bit multiplex gray shades, only four selection periods are ensured for the output from the shift registers. Thus, by considering the width of the erase voltage and the selection voltage to be one selective period, an interval between the erase voltage and the selection voltage is from 0 to 2 selection periods. In the Malvern drive scheme adopting the ferroelectric liquid crystal, an operation error is likely to occur in the selecting operation if a sufficient interval between the selection voltage and the erase voltage is not ensured, and thus the second drive circuit cannot be used. The third drive circuit provides a solution to such problem by increasing the interval between the selection voltage and the erase voltage irrespectively of the number of bits.

Fourth Drive Circuit

The fourth drive circuit is modified form of the second drive circuit in that the shift registers output shift signals by shifting data signals containing two kinds of information having a width of an integer multiple of n selection periods, and that the first and second logical product output means receive an identification signal for identifying the information contained in the data signals as an element of logical AND. The fourth drive circuit further includes: logical negation input means for negating an input state of the identification signal between the first logical product output means and the second logical product output means against each order, and between respective orders of even number and orders of odd number against each other of the first logical product output means and the second logical product output means. The identification signal is a clock having a period of 2n selection periods when the width of the data signal is n multiplied by an even number, while having a period of 3n selection periods when the width of the data signal is n multiplied by an odd number.

In the fourth drive circuit, the data signal to be inputted is shifted in order by the n shift registers, and is outputted in a form of a plurality of shift signals. The data signal has two types of information, for example, selective-use and erase-use information, and the information is contained in the width of the signal. The data signal to be inputted to the shift register may have both the select signal and the erase-use signal within one frame. By adopting such data signal, an improved efficiency can be achieved compared with the case where the select signal and the erase-use signal are respectively divided into two frames.

Then, by the first logical product output means in the order of odd number, a logical AND of the shift signal outputted from each shift register (bit), the select signal and the identification signal is obtained. By the second logical product output means, the shift signal, a logical AND of the shift signal, the blank signal and the identification signal is obtained. Further, by the first logical product output means in the order of even number, a logical AND of the select signal, the shift signal and NOT-identification signal of the negative input means is obtained. By the second logical product output means in the order of odd number, a logical AND of the shift signal, the blank signal and NOT-identification signal by the negative input means is obtained. By the second logical product output means which is in the order of even number, a logical product of the shift signal, the blank signal and the identification signal is obtained.

Further, by the first logical sum output means, a logical OR of the logical ANDs from the first logical product output means based on the shift signals in the same order of output from the shift registers is obtained. On the other hand, by the second logical sum output means, a logical OR of the logical ANDs from the second logical product output means based on the shift signal in the same order of output from the shift registers is obtained.

As a result, when $L_1$ is in the order of an odd number, the logical OR of the scanning electrode $L_i$ is given by the following formula:

$$\{(SR(i)_1 \times SEL_1 \times S/B_1) + (SR(i)_1 \times BL_1 \times \overline{S/B} \times_1)\} + \ldots + \{(SR(i) \times S/B_n \times SEL_n) + (SR(i)_n \times \overline{S/B}_n \times BL_n)\},$$

wherein S/B is an identification signal, and $\overline{S/B}$ is a logical NOT of the identification signal.

When $L_i$ is in the order of even number, the logical OR of the scanning electrode $L_i$ is given by the following formula:

$$\{(SR(i)_1 \times SEL_1 \times \overline{S/B}_1) + (SR(i)_1 \times BL_1 \times S/B_1)\} + \ldots + \{(SR(i)_n \times SEL_n \times \overline{S/B}_n) + (SR(i)_n \times BL_n \times S/B_n)\}.$$

The identification signal S/B is a signal for identifying the selective-use information and eraseuse information. The identification signal S/B is a clock which has 2n selection periods when the width of the data signal is n selection periods multiplied by an even number, while has a period of 3n selection periods when the width of the data signal is n selection periods multiplied by an odd number. Thus, by taking the logical product of the identification signal, the shift signal and the select signal (blank signal), as shown in FIG. 9 or FIG. 10, selective-use information (SS) and the erase-use information (SB) can be fetched. FIG. 9 shows the case where the width of the data signal is two times as long as n-selection periods, while FIG. 10 shows the case where the width of the data signal is n-selection periods.

Here, for example, in the case where the width of the data signal is a selection period multiplied by an odd number, if the identification signal S/B is a clock having a width of 2n selection period, an erase (or selection) voltage is outputted in the period in which the selection voltage (or erase voltage) is to be outputted. Therefore, it is required to set the correlation between the data signal and the identification signal S/B as above:

As described, an input of an identification signal to both logical product output means differs between the selection side and the erase side, and between the order of odd number and the order of even number of the scanning electrode corresponding to the first and second logical product output means. Specifically, the identification signal has a negative correlation between the first logical product output means (selection side) and the second logical product output means (erase side), and between the scanning electrodes in the order of odd number and the scanning electrodes in the order of even number.

Therefore, an identification signal can be inputted in the inverse correlation from the aforementioned case. In this case, $\overline{S/B}$ and S/B are respectively inputted to the first and second logical product output means in the order of odd number, while S/B and $\overline{S/B}$ are inputted respectively in the first and second logical product output means in the order of an even number.

As described, in the fourth drive circuit, the logical ANDs of three signals (shift signal, select signal and identification signal) are obtained, the number of the shift registers can be set to n as in the second drive circuit, and an interval between the selection voltage and an erase voltage can be set as desired. As a result, the number of the shift registers can be reduced to one half of the third drive circuit, thereby permitting multiplex gray shades display having a high degree of freedom with simplified structure.

Fifth Drive Circuit

The fifth drive circuit includes selection shift registers for outputting a selection shift signals in the same number as scanning electrodes by shifting a selection data signal having a width of not less than two periods of a clock in sync with the clock; first logical product output means for obtaining a logical AND of selection shift signals outputted from three adjoining output terminals of the selection shift registers; second logical product output means for obtaining a logical AND of selection shift signals, which are respectively first and second in order of output among three selection shift signals, and a first select signal having a constant period for determining a selection voltage application period when the selection voltage is first applied to a specific one of three adjoining scanning electrodes; third logical product output means for obtaining a logical AND of selection shift signals which are respectively second and third in order of output among the three selection shift signals and a second select signal having a constant period for determining a selection voltage application period when applying the selection voltage last to t he specific scanning electrode; and first logical sum output means for obtaining a logical OR of logical ANDs from the first logical product output means, the second logical product output means, and the third logical product output means.

In the described Malvern drive schemes (see FIG. 21), the selection voltage is applied over two selection periods. For example, in the first through fifth selection periods, a selection voltage is applied to respective groups of the three scanning electrodes ($L_{i-3}$, $L_{i-2}$, $L_{i-1}$) , ($L_{i-2}$, $L_{i-}$, $L_i$), ($L_{i-1}$, $L_i$, $L_{i+1}$), ($L_i$, $L_{i+1}$, $L_{1+2}$) and ($L_{i+1}$, $L_{i+2}$, $L_{i+3}$). Namely, to a single scanning electrode, the selection voltage is applied to three successive selection periods.

For example, for the scanning electrode $L_i$, in the selection period (the second selective period of the above example) in which the selection voltage is applied first to the scanning electrode $L_i$, the selection voltage is applied also to the scanning electrode $L_{i-1}$ at the same time, but the selection voltage is not applied to the scanning electrode $L_{i+1}$. On the other hand, in the selection period (the fourth selective period of the above example) in which the selection voltage is applied last to the scanning electrode $L_i$, the selection voltage is applied to the scanning electrode $L_{i+1}$ at the same time, but the selection voltage is not applied to the scanning electrode $L_{i-1}$. In the intermediate selection period (the third selection period of the above example) in which the voltage is applied to the scanning electrode $L_i$ in-between, the selection voltage is applied to both the scanning electrode $L_{i-1}$ and the scanning electrode $L_{i-1}$ at the same time.

In the described manner, the selection period in which the selection voltage is applied first, the selection period in which the selection voltage is applied last and the intermediate selection period are distinguished for the specific scanning electrode $L_i$ among the adjoining three scanning electrodes. As a result, the selection voltage can be applied over two or more selection periods for a duration as desired. Therefore, even in the case of adopting such drive method that the duration of the selection voltage is longer than the selection period like the Malvern drive scheme, the selection voltage can be applied to the scanning electrode with ease, thereby permitting the gray shades display by the driver IC.

Specifically, in the selection period in which the selection voltage is applied first and last to the scanning electrode $L_i$, selection voltage control signals are prepared using the select signal of the first selection period and the select signal of the last selection period respectively. On the other hand, in the intermediate selection period, a selection voltage control signal is prepared without using a select signal. As a result, a selection voltage can be applied in the described manner.

In the fifth drive circuit, the inputted selective data signal is shifted in order by the selective shift register, to be outputted as a plurality of selective shift signals. The adjoining three shift signals are subjected to logical computation by the first through third logical product output means.

By the first logical product output means, a logical AND of the adjoining three selective shift signals is obtained. By the second logical product output means, a logical product of the selective shift signals to be outputted first and second of the three selective shift signals and the select signal for the first selection period is obtained. Further, by the third logical product output means, a logical product of the selective shift signals in the second and third orders of output of the three selective shift signals and the second select signal, i.e., the select signal for the last selection period is obtained. By the first logical sum output means, a logical OR of the three logical ANDs is obtained.

The logical computations by the first through third logical product output means and the first logical sum output means are shown by the following formula:

$$(SR_{i-1} \times SR_i \times \overline{SR}_{i+1} \times SLF) + (SR_{i-1} \times SR_i \times SR_{i+1}) + (\overline{SR}_{i-1} \times SR_i \times SR_{i+1} \times SLL) = (SR_{i-1} \times SR_i \times SLF) + (SR_{i-1} \times SR_i \times SR_{i+1}) + (SR_i \times SR_{i+1} \times SLL),$$

wherein SLF and SLL are the first and second select signals, $\overline{SR}_{i+1}$ is a logical NOT of $SR_{i+1}$, and $\overline{SR}_{i-1}$ is a logical NOT of $SR_{i-1}$.

By applying the selection voltage using a control signal as a result of the described logical computation, the duration of the selection voltage can be set longer than the selective period.

Sixth Drive Circuit

The sixth drive circuit having an arrangement of the fifth drive circuit includes erase shift registers for outputting erase shift signals in the same number as the scanning electrodes by shifting erase data signals in phase different from that of the selection data signal in sync with the clock, the erase data signal having a width of not less than two frequencies of the clock; fourth logical product output means for obtaining a logical AND of the erase shift signals outputted from three adjoining output terminals of the erase shift registers; fifth logical product output means for obtaining a logical product of the erase shift signals which are first and second in order of output among the three erase shift signals and a first blank signal having a constant period for determining an erase voltage application period when the erase voltage is first applied to the specific scanning electrode; sixth logical product output means for obtaining a logical AND of the erase shift signals which are second and third in order of output among three erase shift signals and a second blank signal having a constant period for determining the erase voltage application period when the erase voltage is applied last to the specific scanning electrode; and second logical sum output means for obtaining a logical OR of the logical ANDs from the fourth through sixth logical product output means.

The sixth drive circuit permits the duration of the erase voltage to be set longer than the selection period as in the first drive circuit. Thus, the adjoining three erase-use shift signals obtained by shifting the erase-use data signal by the erase-use shift register and the blank signals for the first and last erase voltage application periods are used. By the fourth through sixth logical product output means, three logical ANDs based on the erase-use shift signal, and the two blank signals are obtained. Further, a logical OR of these respective logical ANDs is obtained by the second logical sum output means.

By applying a selection voltage using a control signal as a result of the described logical computation obtained in the described manner, the duration of the erase voltage can be set longer than the selection period. Namely, even when adopting such driving method that the duration of the erase voltage is longer than the selection period, the erase voltage can be applied to the scanning electrode with ease.

Seventh Drive Circuit

The seventh drive circuit can be applied to any of the second, third, fourth, and sixth drive circuits, and includes signal output means, a selection voltage switch, a non-selection voltage switch and an erase voltage switch. The signal output means outputs three signals only one of which is significant based on the logical ORs from the first and second logical sum output means. The selection voltage switch, the non-selection voltage switch and the erase voltage switch are switched ON/OFF based on the described three signals, and are switched ON when the signal is significant so as to respectively apply the selection voltage, the non-selection voltage and the erase voltage to the scanning electrode independently. The selection voltage switch, the non-selection voltage switch and the erase voltage switch are constituted by, for example, an analog switch.

In the seventh drive circuit, three signals are outputted based on the logical ORs from the first and second logical sum output means by the signal output means. Then, as either one of the three signals becomes significant, a switch can be switched ON by the signal which becomes significant.

As a result, when one of the signals (selection voltage control signal) becomes significant (for example, High level), the selection voltage switch is switched ON, and other switches are switched OFF, whereby a selection voltage is outputted via the selection voltage switch in the ON state. On t he other hand, when another signal (non-selection voltage control signal) is significant, the non-selection voltage switch is switched ON, and other switches are switched OFF, whereby a non-selection voltage is outputted through the non-selection voltage switch in the ON state. Further, when a still another signal (erase voltage control signal) is significant, the erase voltage switch is switched ON, and other switches are switched OFF, whereby the erase voltage is outputted via the erase voltage switch.

As described, in the seventh drive circuit, three signals are obtained based on two logical ORs from the first and second logical sum output means, and one of the selection voltage, the non-selection voltage and the erase voltage is outputted based on the resulting three signals. As a result, the voltages in the greater number than the number of input signals can be applied to the scanning electrodes, thereby permitting an effective use of input signals.

Eighth Drive Circuit

The eighth drive circuit is applied to the seventh drive circuit, and includes OFF means for switching the selection voltage switch OFF when the signal to be applied to the selection voltage switch is significant. Alternatively, it may be also arranged such that the erase voltage switch is switched OFF when the signal to be applied to the erase voltage switch is significant.

When the eighth drive circuit is applied for driving the capacitive load such as the liquid crystal panel, even when the selection voltage control signal is significant, by switching OFF the selection voltage switch, the selection voltage output terminal of the drive circuit to be connected to the liquid crystal panel becomes high impedance. Similarly, the erase voltage output terminal also becomes high impedance.

As a result, at the output terminal of the high impedance, the voltage level directly before that time is maintained. Thus, by adjusting the timing of switching OFF the selection voltage switch or the erase voltage switch, the voltage of a level as desired can be applied to the liquid crystal panel. As this permits respective levels of the selection voltage and the erase voltage to be set as desired with ease, various multiplex gray shades displays can be performed.

Ninth Drive Circuit

The ninth drive circuit is applicable to any one of the second, the third, the fourth or the sixth drive circuit and includes a reversal amplifier for amplifying a difference between a sum of voltages based on the logical ORs from the first and the second logical sum output means to be inputted to the reversal input terminal and a reference voltage to be inputted to the non-reversal input terminal at a predetermined amplification degree. The reversal amplifier is, for example, arranged such that a resistor $R_0$ is connected across the reversal input terminal and the output terminal of the operational amplifier; while resistor $R_m$ of m kinds are connected to the reversal input terminal in parallel (resistance value is selected at random).

In the ninth drive circuit, by inputting the voltage based on the respective logical ORs from the first and second logical sum output means through each resistance $R_m$, the sum of these voltages is inputted to the reversal input terminal. To the non-reversal input terminal, a reference voltage $V_0$ is inputted. Further, the input voltages in the "High" level and the "Low" level are respectively denoted as $V_S$ and $V_0$. Here, the voltage to be outputted is shown by the following formula:

$$V_{out}=(V_0-V_S)R_o\Sigma(P_m/R_m)+V_0,$$

wherein $P_m$ indicates the state of each voltage control signal and takes a value of "0" or "1".

Here, as the combinations of m $P_m$ are the 'm'th power of 2, and the output voltage has potential levels of 'm'th power of 2. Thus, by adopting such reversal amplifier, many potentials can be generated using few signals. Thus, when obtaining the output voltages of many kinds, the number of input signals can be reduced, and switches and the power source line of a selection voltage, etc., adopted in the eighth drive circuit can be omitted, thereby permitting a miniaturization of the driving circuit.

For a fuller understanding of the nature and advantages of the invention, reference should be made to the ensuing detailed description taken in conjunction with the accompanying drawings

BRIEF DESCRIPTION OF THE DRAWINGS

FIG. 17(*b*) is a perspective view showing the state of a molecule of the ferroelectric liquid crystal in the smectic C phase.

FIG. 19(*a*) and FIG. 19(*b*) are waveform diagrams showing a waveform of a pulse voltage used in measuring switching characteristics of FIG. 18.

DESCRIPTION OF THE EMBODIMENTS

FIRST EMBODIMENT

The following descriptions will discuss one embodiment of the present invention in reference to FIG. 1 through FIG. 12.

[Basic Structure of Ferroelectric Liquid Crystal Display Apparatus]

Figure 2:
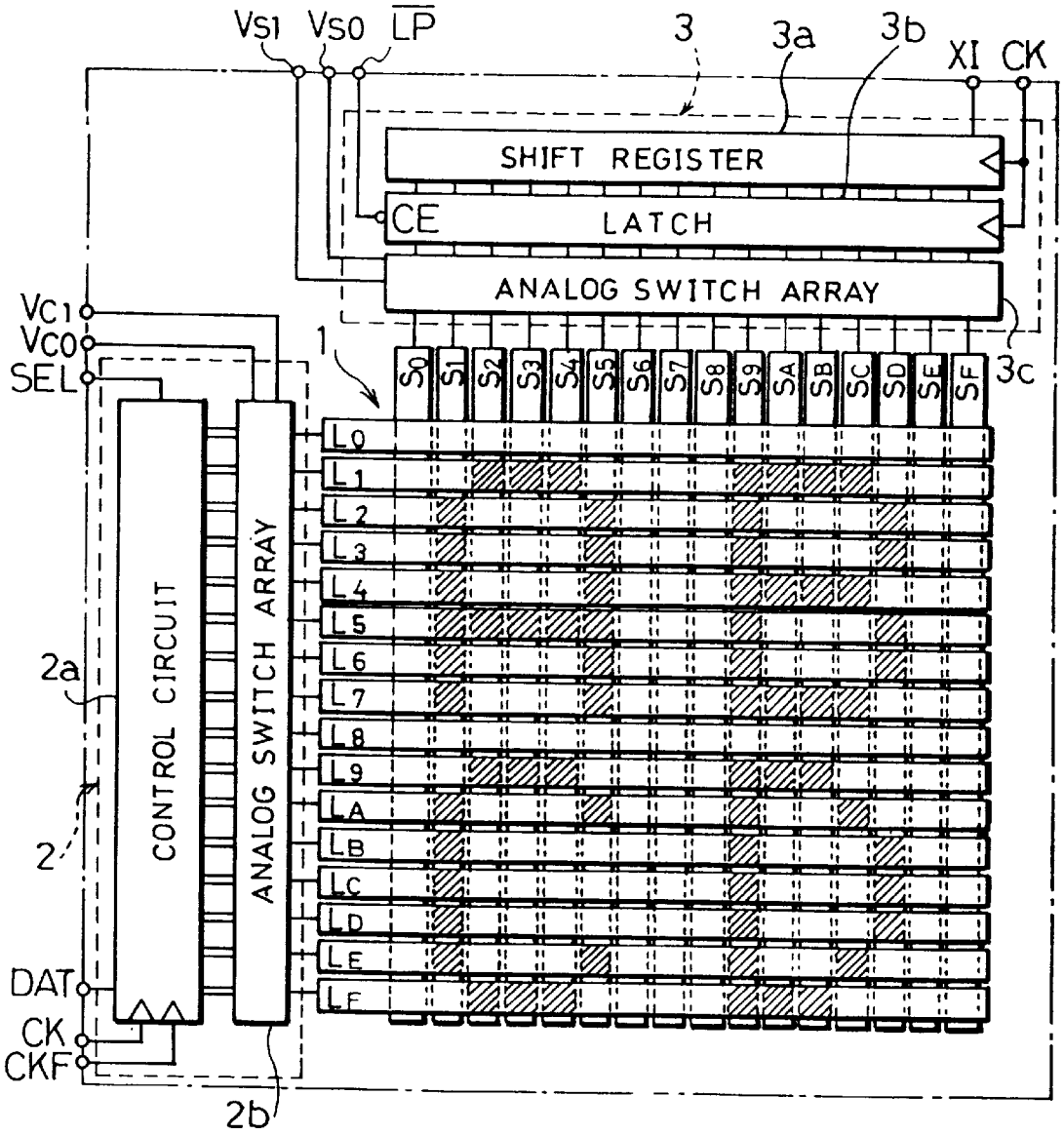
FIG. 2 is a block diagram showing a structure surrounding a liquid crystal panel of a liquid crystal display apparatus in accordance with one embodiment of the present invention.
Figure 15:
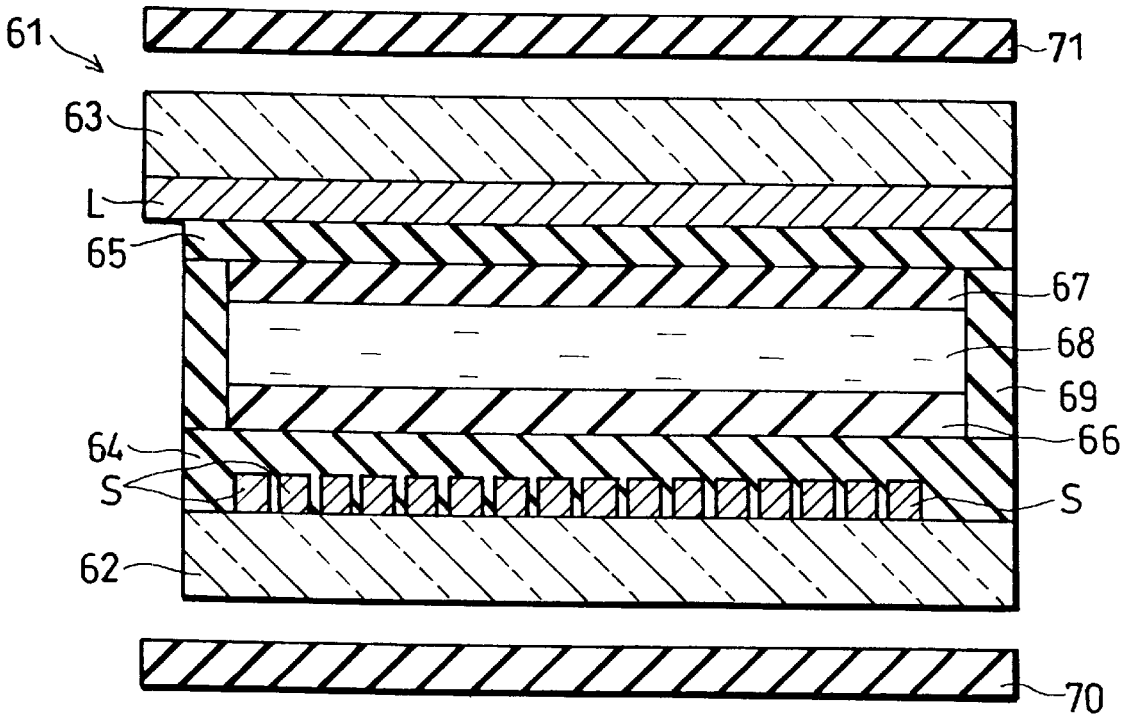
FIG. 15 PRIOR ART
FIG. 15 is a cross-sectional view showing the structure of a liquid crystal panel adopted in the conventional FLCD.
Figure 16:
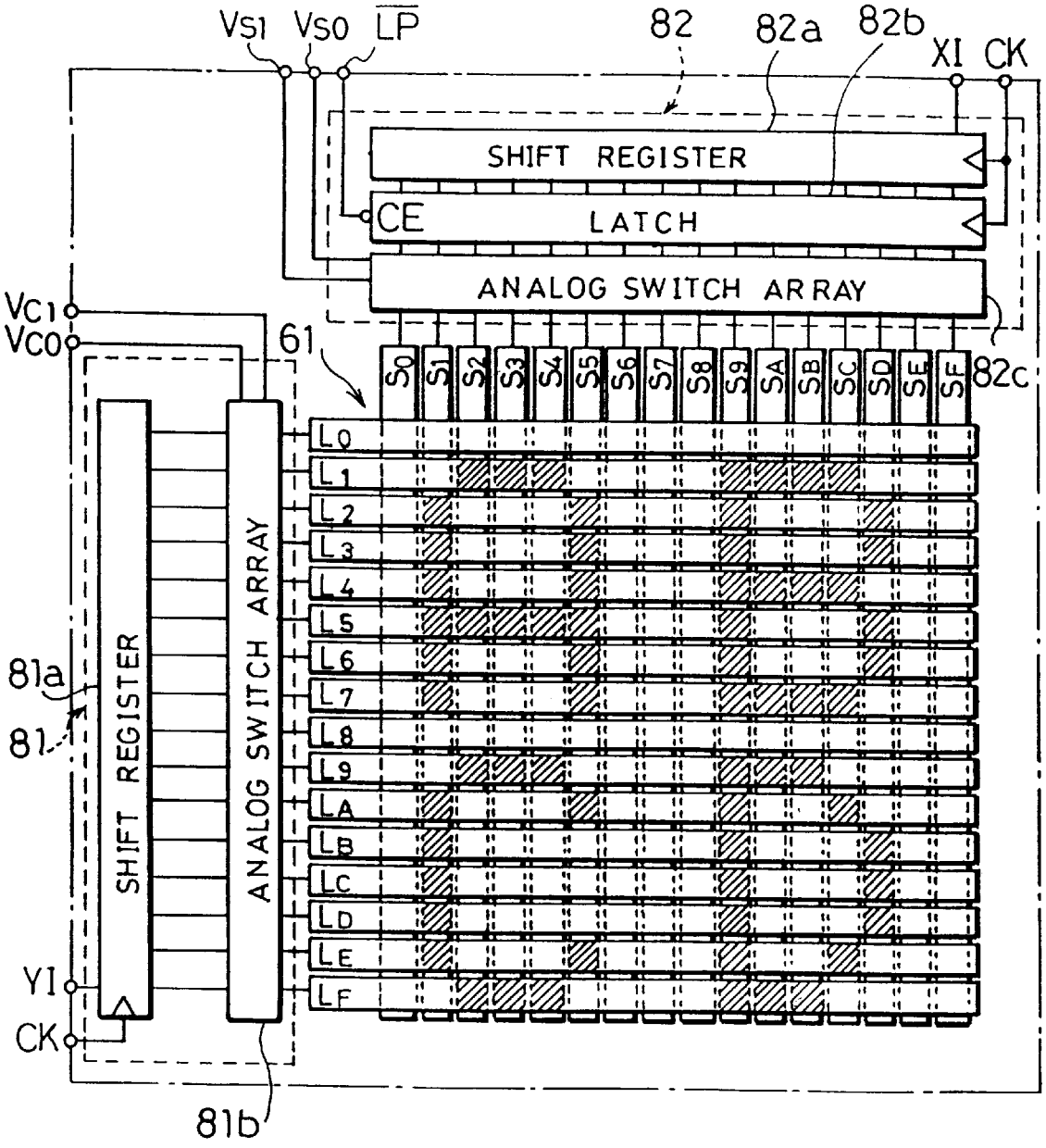
FIG. 16 PRIOR ART
FIG. 16 is a block diagram showing the structure surrounding the liquid crystal panel of the conventional FLCD.
Figure 17:
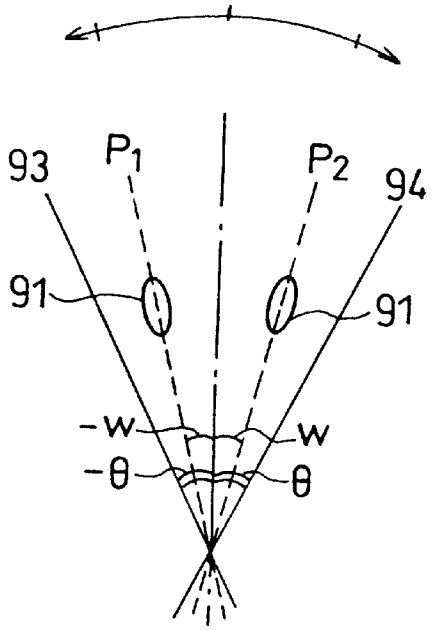
FIG.17 (a) PRIOR ART
FIG. 17(*a*) is an explanatory view showing molecule state of a ferroelectric liquid crystal sealed in the liquid crystal panel taken from the side of the glass substrate.
Figure 17:
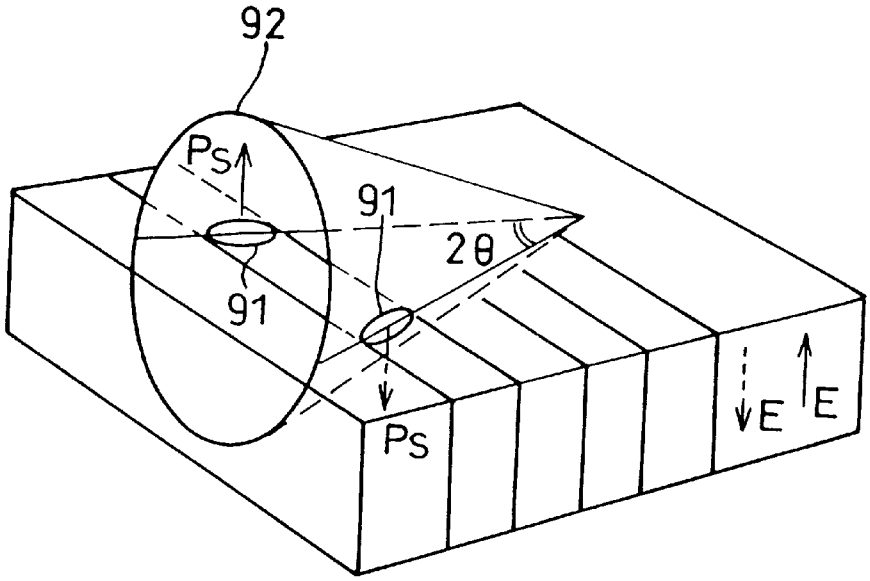
FIG. 17 (b) PRIOR ART
Figure 18:
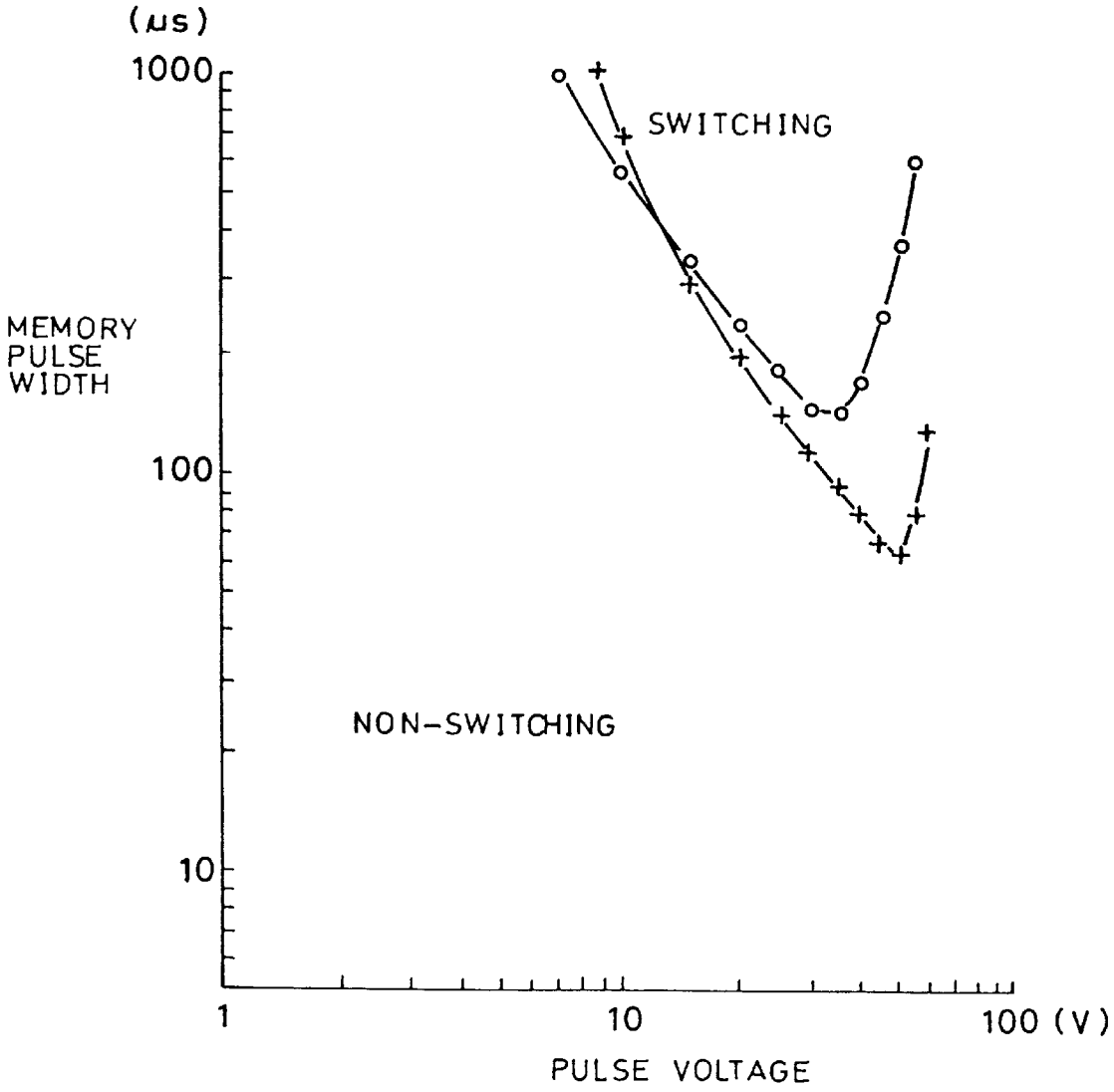
FIG. 18 PRIOR ART
FIG. 18 is a graph showing switching characteristics of the ferroelectric liquid crystal.
Figure 20:
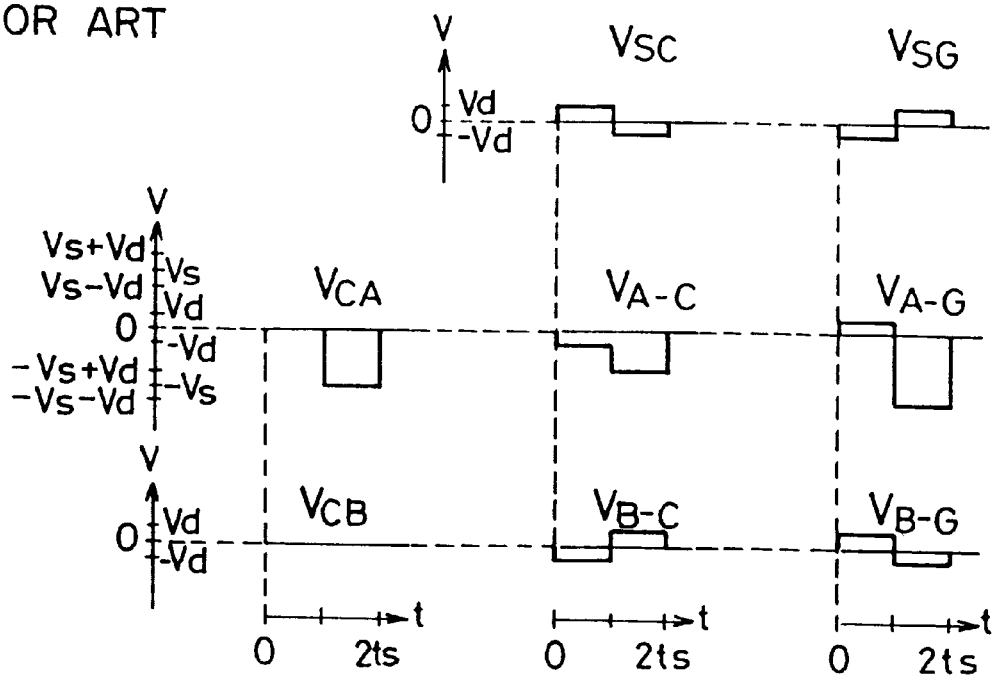
FIG. 20 (a) PRIOR ART
FIG. 20(*a*) and FIG. 20(*b*) are waveform diagrams showing the waveform of the drive voltage in the first and second fields by the JOERS/Alvey drive scheme suited as the driving method of the FLCD of FIG. 16.
Figure 20:
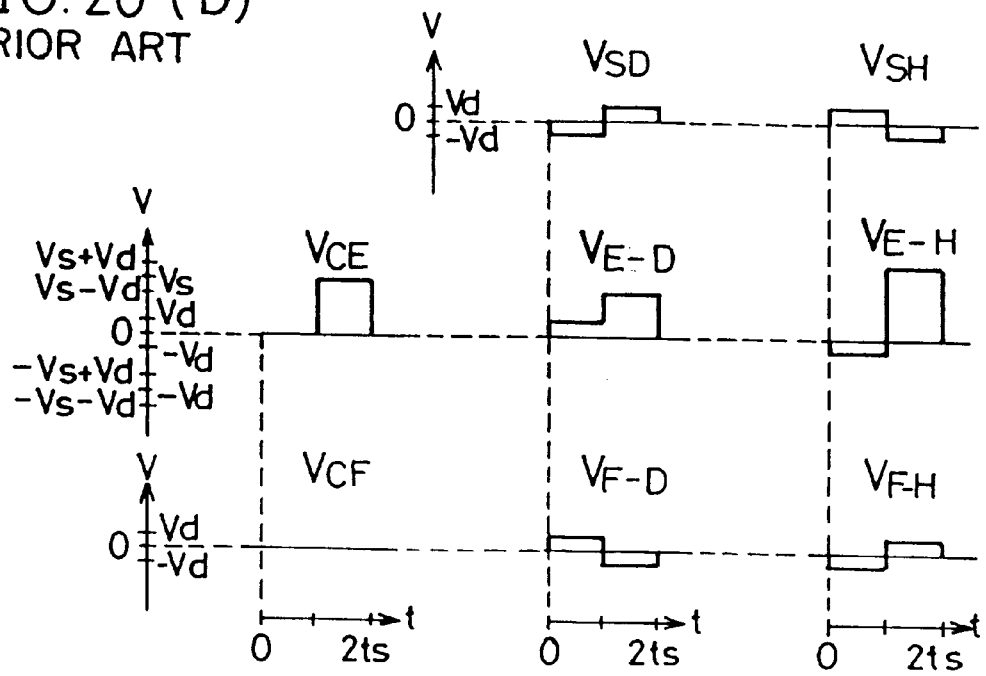
FIG. 20 (b) PRIOR ART
Figure 21:
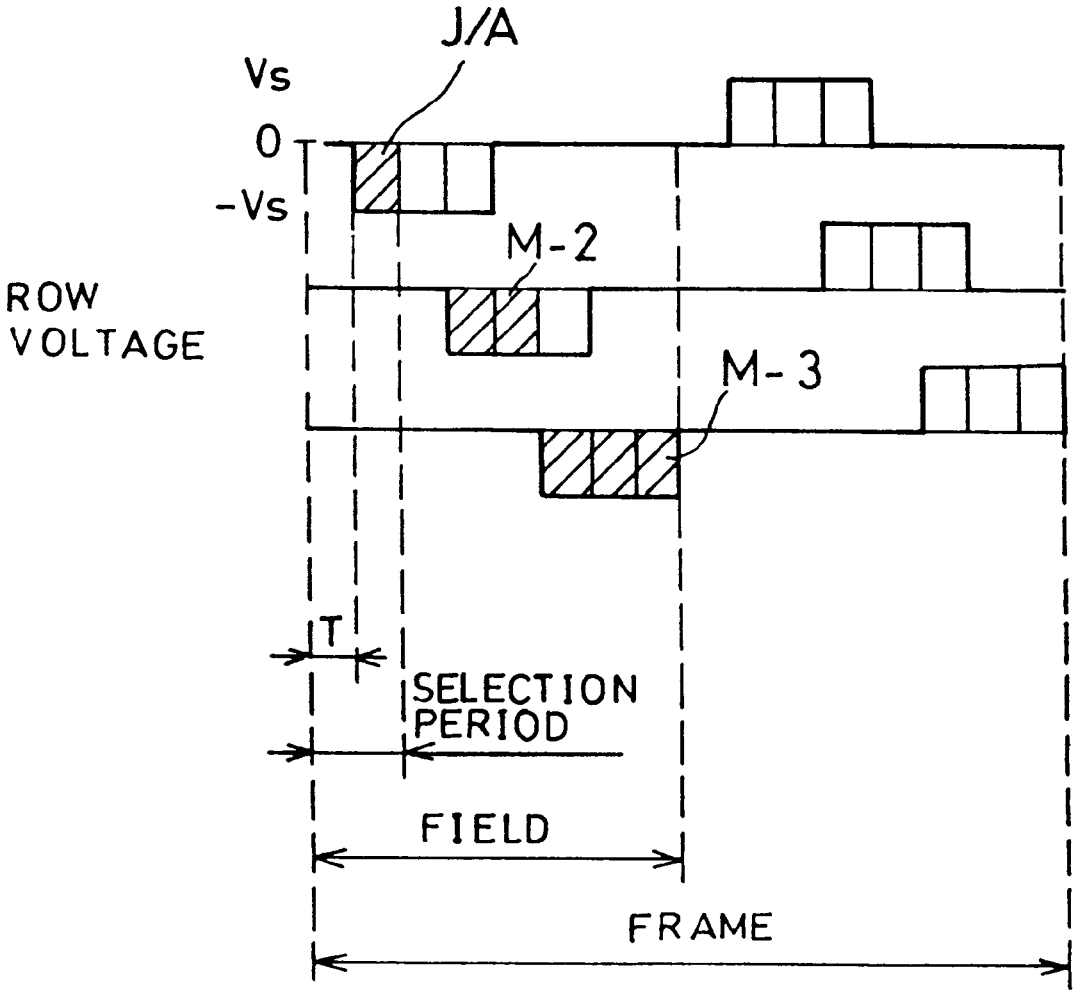
FIG. 21 PRIOR ART
FIG. 21 is a waveform diagram showing a voltage of the Malvern drive scheme, and a voltage of the JOERS/Alvey drive scheme to be applied to the FLCD of FIG. 16.
Figure 22:
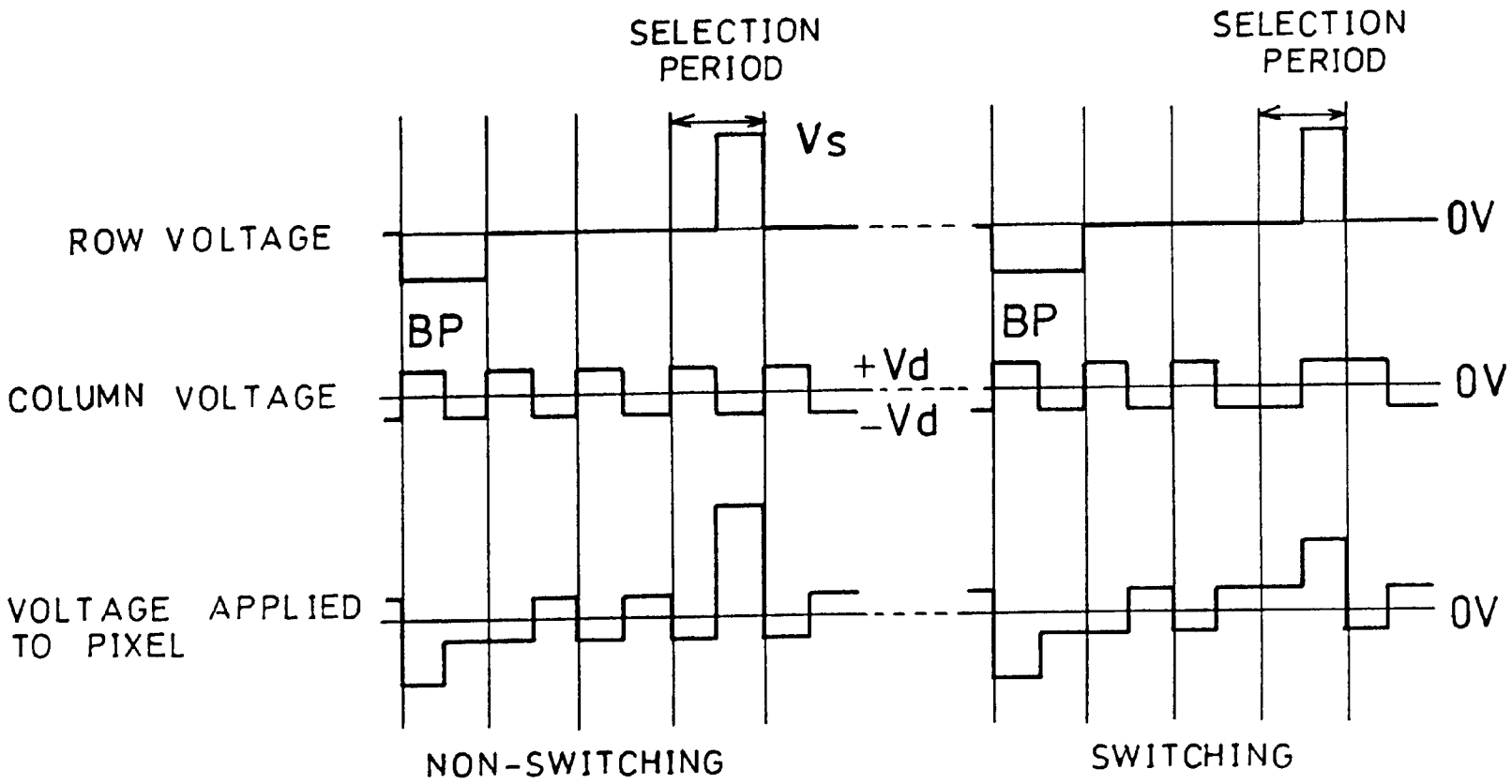
FIG. 22 PRIOR ART
FIG. 22 is a waveform diagram showing a waveform of a drive voltage in the non-switching state and the switching state by the blanking drive method to be applied to the FLCD of FIG. 16.

As shown in FIG. 2, a ferroelectric liquid crystal display apparatus (hereinafter referred to as FLCD) in accordance with the present embodiment includes a liquid crystal panel 1 having the same structure as FLCD (see FIG. 15) described under Prior Art. The liquid crystal panel 1 includes a plurality of scanning electrodes L and a plurality of signal electrodes S. The scanning electrode L and the signal electrodes S cross each other with a predetermined space between them, and a ferroelectric liquid crystal (not shown) is sealed in the space.

The scanning electrodes L are connected to the scanning driver 2, and the signal electrodes S are connected to the signal driver 3. For simplification, the liquid crystal panel 1 shown in FIG. 2 has such structure that 16 scanning electrodes ($L_0$ through $L_F$) and 16 signal electrodes S ($S_0$ through $S_F$) cross each other to form 16×16 pixels.

The scanning driver 2 is a circuit for applying a voltage to the scanning electrodes L and includes a control circuit 2*a* and an analog switch array 2*b*. The scanning driver 2 has a plurality of shift registers 11 through 14, etc., (see, for example, FIG. 1), and controls an operation of the analog switch array 2*b*.

The analog switch array 2*b* outputs a select signal $V_{C1}$ or a non-selection voltage $V_{c0}$ to the scanning electrode $L_i$ based on a control signal from the control circuit 2*a*. Also, the analog switch array 2*b* outputs an erase voltage $V_{c2}$ (see FIG. 4) (to be described later) to the scanning electrode $L_i$ if necessary.

The signal driver 3 is a circuit for applying a voltage to the signal electrode S and includes a shift register 3*a*, a latch 3*b* and an analog switch array 3*c*. The signal driver 3 transfers a data signal XI by the shift register 3*a* based on the clock CK, and the signal is outputted from each output terminal of the shift register 3*a*.

The signal outputted from the shift register 3*a* is held by the latch 3*b* in sync with the latch pulse LP of the negative logic.

When the value held by the latch 3*b* is significant (for example, High level), the analog switch array 3*c* applies an active voltage $V_{s1}$ to the signal electrode $S_j$ corresponding to the signal line to which the value is outputted. On the other hand, when the value held by the latch 3*b* is not significant (for example, Low level), the analog switch array 3*c* applies a non-active voltage $V_{S0}$ to the signal electrode $S_k$ (k≠j) corresponding to the signal line to be outputted.

In the present embodiment, explanations have been given through the FLCD. However, the present invention is also applicable to other matrix-type display apparatus having memory effect.

The following will explain the respective structures of the scanning driver 2. The below-explained 1st through the 5th scanning drivers are consisted so as to realize a 4-bit multiplex gray shades display.

First Scanning Driver

Figure 1:
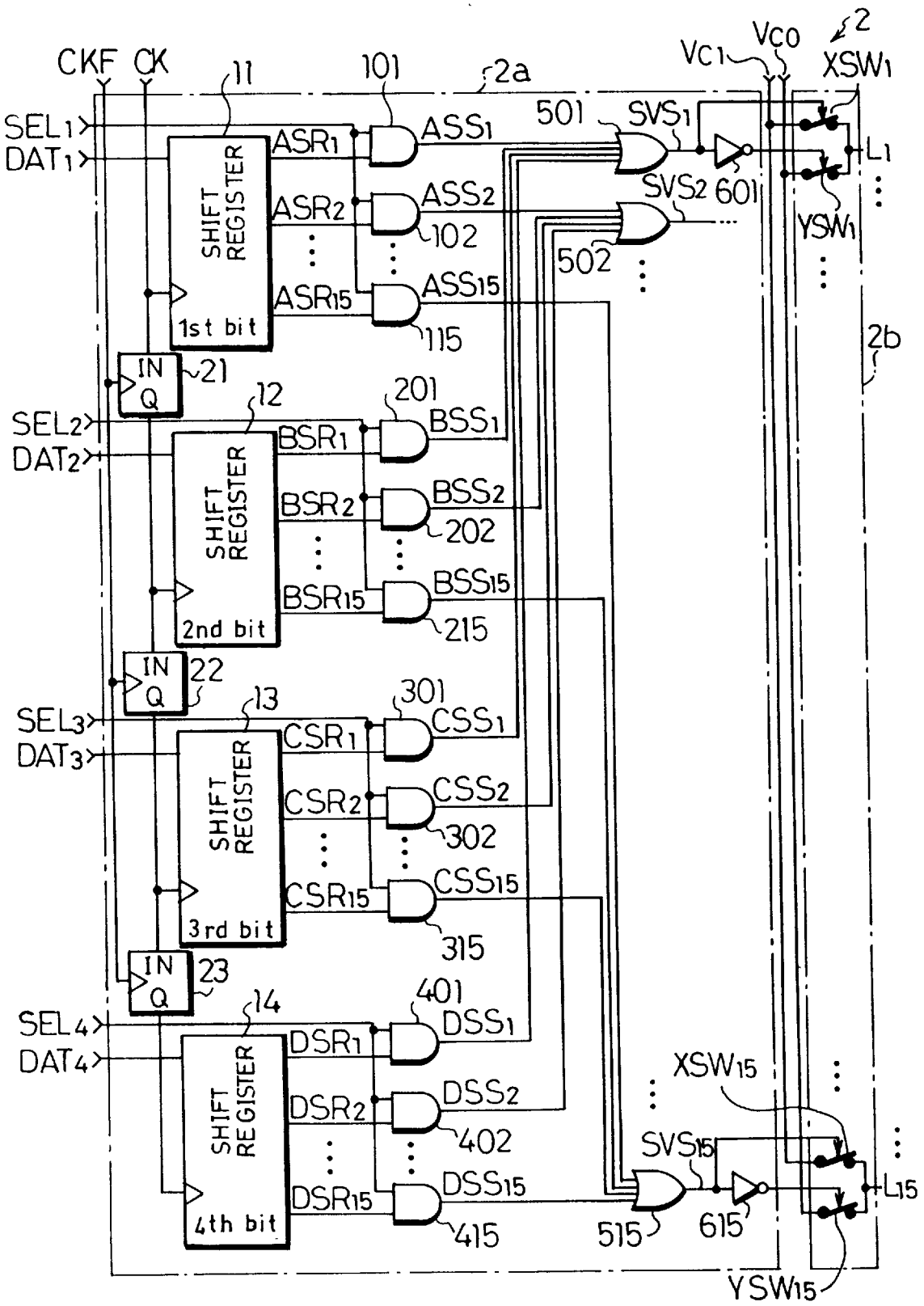
FIG. 1 is a circuit diagram showing a structure of the first scanning driver in accordance with one embodiment of the present invention.

As shown in FIG. 1, the scanning driver 2 in accordance with the present embodiment is arranged so as to apply a voltage of 4-bit for a multiplex gray shades display to fifteen scanning electrodes $L_1$ through $L_{15}$. The control circuit 2*a* includes shift registers 11 through 14, AND circuits 101 through 115, 201 through 215, 301 through 315 and 401 through 415, the flip flops 21 through 23, OR circuits 501 through 515, and inverters 601 through 615.

To the shift registers 11 through 14, four bits which constitute data to be inputted to the signal driver 3 are inputted as bit data $DAT_1$ through $DAT_4$. The shift register 11 outputs shift signals $ASR_1$ through $ASR_{15}$ from respective fifteen output terminals by shifting the bit data $DAT_1$ sequentially to the output of the next stage based on the clock CK. The shift registers 12 through 14 shift the data sequentially to the output of the next stage based on the clock CK shifted sequentially by one selection period using flip flops 21 through 23. As a result, from respective fifteen output terminals of the shift registers 12 through 14, the shift signals $BSR_1$ through $BSR_{15}$, $CSR_1$ through $CSR_{15}$ and $DSR_1$ through $DSR_{15}$ are outputted. The flip flops 21 through 23 shift the clock CK based on the clock CKF.

By the AND circuits 101 through 115 (first logical product output means), a logical AND of the select signal $SEL_1$ and the shift signals $ASR_1$ through $ASR_{15}$ is obtained respectively. By the AND circuits 201 through 215, a logical AND of the select signal $SEL_2$ and the shift signal $BSR_1$ through $BSR_{15}$ is obtained respectively. By the AND circuits 301 through 315, a logical AND of the select signal $SEL_3$ and the shift signal $CSR_1$ through $CSR_{15}$ is obtained respectively. By the AND circuits 401 through 415, a logical AND of the select signal $SEL_4$ and the shift signal $DSR_1$ through $DSR_{15}$ is obtained respectively.

By the OR circuits 501 through 515 (first logical sum output means), a logical OR of four AND signals $ASS_i$, $SBS_i$, $CSS_i$ and $DSS_i$ (i=1 through 15) in the 'i'th order (the same order) from the AND circuits 101 through 115, 201 through 215, 301 through 315 and 401 through 415 is obtained. The respective output signals from the OR circuits 501 through 515 are applied to the analog switch array 2*b* as control signals $SVS_1$ through $SVS_{15}$.

The inverters 601 through 615 are provided respectively at the stage next to the OR circuits 501 through 515. These inverters 601 through 615 invert the respective control signals $SVS_1$ through $SVS_{15}$ from the OR circuits 501 through 515.

The analog switch array 2*b* includes switches $XSW_1$ through $XSW_{15}$, $YSW_1$ through $YSW_{15}$. The switches $XSW_1$ through $XSW_{15}$ as the selection voltage switches are switched ON/OFF respectively by the control signals $SVS_1$ through $SVS_{15}$. The switches $YSW_1$ through $YSW_{15}$ as the non-selective voltage switches are switched ON/OFF respectively by the inverted control signals obtained by inverting the control signals $SVS_1$ through $SVS_{15}$ by the inverters 601 through 615.

The switches $XSW_1$ and $YSW_1$, switches $XSW_2$ and $YSW_2$, . . . , $XSW_{15}$ and $YSW_{15}$ respectively form pairs. To the scanning electrodes $L_1$ through $L_{15}$, the selection voltage $V_{c1}$ or the non-selection voltage $V_{co}$ is applied. Specifically, upon inputting the control signals $SVS_1$ through $SVS_{15}$ of High level, the switches $XSW_1$ through $XSW_{15}$ are switched ON, and output the selection voltage $V_{c1}$ to the scanning electrode $L_1$ through $L_{15}$. On the other hand, upon inputting the inverted control signals of High level, the switches $YSW_1$ through $YSW_5$ are switched ON to output the non-selection voltage $V_{co}$ to the scanning electrodes $L_1$ through $L_{15}$.

An operation of the scanning driver 2 having the described arrangement will be explained in reference to a time chart shown in FIG. 3.

First, the clock becomes clocks $CK_1$ through $CK_4$ having a period of four selection periods obtained by shifting by the flip flops 21 through 23 by one selection period, and the resulting clocks $CK_1$ through $CK_4$ are respectively inputted to the shift registers 11 through 14. Each of the bit data $DAT_1$ through $DAT_4$ is inputted to the shift registers 11 through 14 at a timing corresponding to a required gray shades level.

Fifteen shift signals $ASR_1$ through $ASR_{15}$, $BSR_1$ through $BSR_{15}$, $CSR_1$ through $CSR_{15}$, and $DSR_1$ through $DSR_{15}$ respectively have a width of four selection periods. The shift signals $ASR_1$ through $ASR_{15}$ are respectively ANDed to the select signal $SEL_1$ by the AND circuits 101–115 as follows:

$$ASR_i \times SEL_1 = ASS_i (i=1 \text{ through } 15),$$

Then, the shift signals $ASR_1$ through $ASR_{15}$ are shaped into the AND signals $ASS_1$ through $ASS_{15}$. Similarly, the shift signals $BSR_1$ through $BSR_{15}$, $CSR_1$ through $CSR_{15}$, and $DSR_1$ through $DSR_{15}$ are respectively ANDed to the select signals $SEL_2$ through $SEL_4$ by the AND circuits 201 through 215, 301 through 315, and 401 through 415, and are shaped into the AND signals $BSS_1$ through $BSS_{15}$, $CSS_1$ through $CSS_{15}$, and $DSS_1$ through $DSS_{15}$.

Thereafter, a logical OR of the AND signals $ASS_i$, $BSS_i$, $CSS_i$ and $DSS_i$ (i=1 through 15) is obtained by the OR circuits 501 through 515 as follows:

$$ASS_i + BSS_i + CSS_i + DSS_i = SVS_i,$$

Then, the resulting logical OR is supplied to the analog switch array 2*b* as the control signal $SVS_i$. The control signal $SVS_i$ becomes an inverse control signal by being inverted by the inverters 601 through 615 to be supplied to the analog switch array 2*b*.

In the analog switch array 2*b*, the switch $XSW_i$ is switched ON when the control signal $SVS_i$ is in the High level. As a result, the selection voltage $V_{c1}$ is outputted from the output terminal of the scanning driver 2 through the switch $XSW_i$, and is applied to the scanning electrode $L_i$. Here, as the switch $YSW_i$ is switched OFF, a non-selection voltage $V_{c0}$ is not applied to the scanning electrode $L_i$. On the other hand, the switch $YSW_i$ is switched ON when the control signal $SVS_i$ is in the Low level. As a result, the non-selection voltage $V_{c0}$ is outputted from the output terminal of the scanning driver 2 through the switch $YSW_i$ to be applied to the scanning electrode $L_i$.

Figure 3:
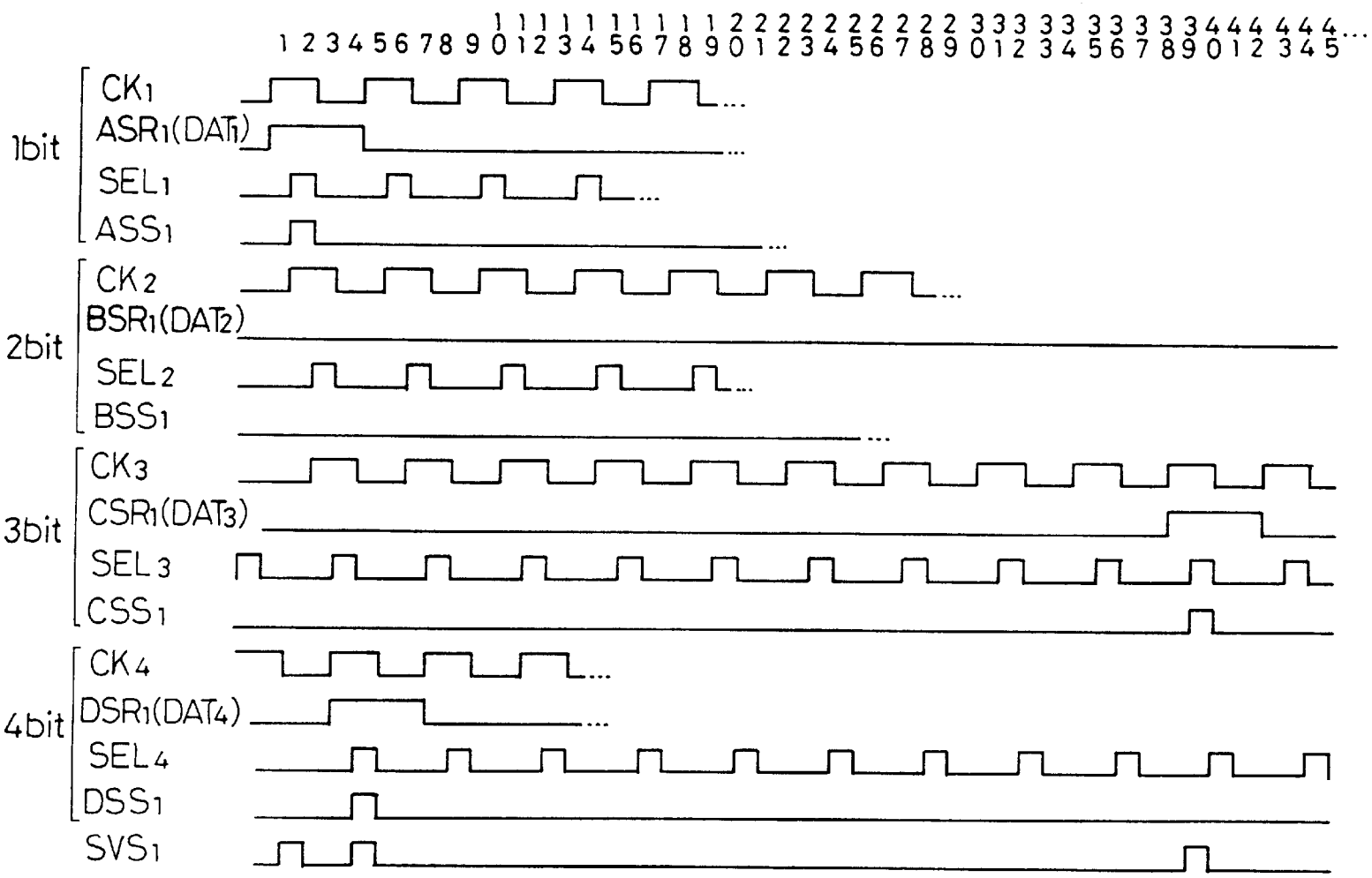
FIG. 3 is a time chart showing an operation of a voltage to be applied to a scanning electrode $L_1$ by the first scanning driver.

As shown in FIG. 3, as respective phases of the clock $CK_1$ through $CK_4$ and the select signals $SEL_1$ through $SEL_4$ are shifted by one selection period for the shift registers 11 through 14, the respective 4-bit selection voltages are not overlapped with each other.

As can be seen from FIG. 3, the clocks $CK_1$ through $CK_4$, bit data $DAT_1$ through $DAT_4$ and select signals $SEL_1$ through $SEL_4$ respectively have simple waveforms.

Figure 14:
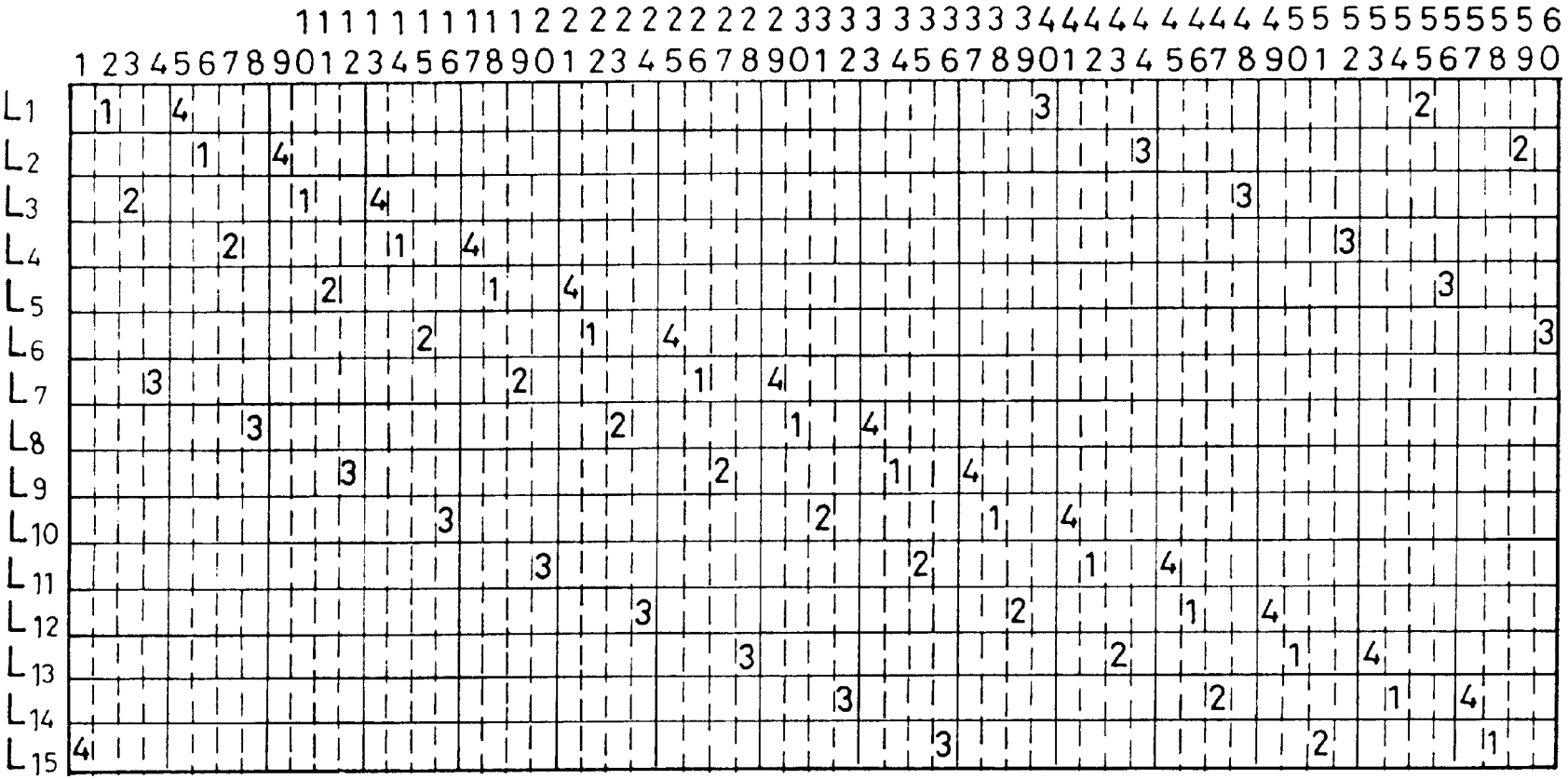
FIG. 14 is an explanatory view showing a scanning pattern by the scanning driver of the conventional FLCD and the FLCD in accordance with one embodiment of the present invention.

Furthermore, the selection voltage is outputted at the same timing as the scanning pattern shown in FIG. 14 from the first scanning driver 2 operated based on the described waveform. As a result, for example, in the case of the scanning electrode $L_1$, the data of the first bit is displayed in the second selection period, and the data of the fourth bit is displayed in the fifth selection period.

Therefore, by adopting the first scanning driver 2, a multiplex gray shades display can be performed using the input signal of a simple waveform.

Second Scanning Driver

Figure 4:
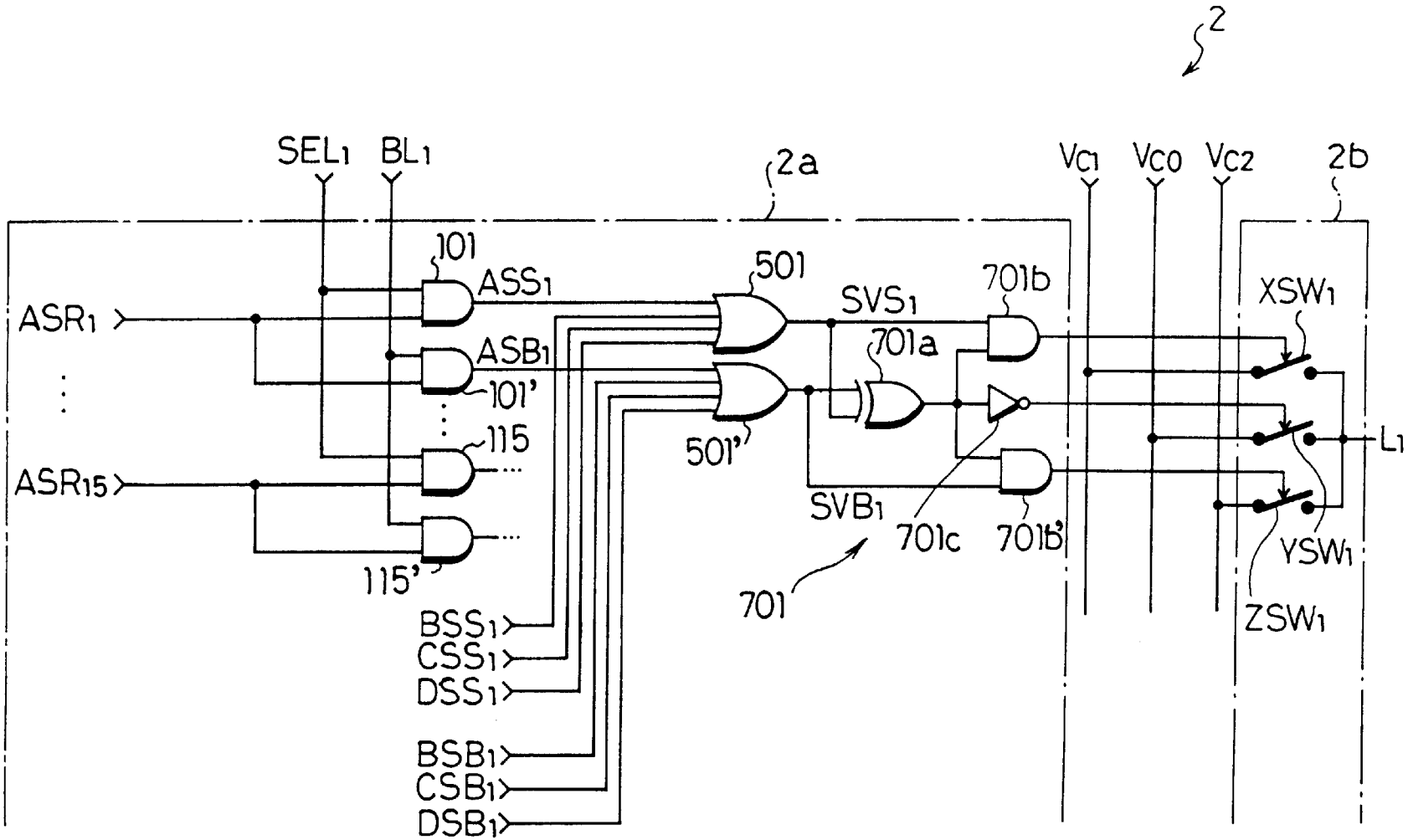
FIG. 4 is a circuit diagram showing a part of the structure of the second scanning driver in accordance with one embodiment of the present invention.

As shown in FIG. 1, the second scanning driver 2 has the same arrangement as the first scanning driver 2 for the shift registers 11 through 14, and has arrangement shown in FIG. 4 after the shift registers 11 through 14.

For the structures and signals having the same arrangement of the first scanning driver, the explanations thereof shall be omitted. For simplification, FIG. 4 mainly shows the structure of the processing system of a scanning electrode $L_1$.

The control circuit 2*a* of the scanning driver 2 includes AND circuits 101 through 115, AND circuits 101' through 115', OR circuits 501 and 501', and a logical circuit group 701.

By the AND circuit 101' (through 115'), logical ANDs of erase-use select signals $BL_1$ and shift signal $ASR_1$ through $ASR_{15}$ are respectively obtained. The select signal $BL_1$ ($BL_2$ through $BL_4$) as a blank signal has a phase in ahead of the select signal $SEL_1$ ($SEL_2$ through $SEL_4$) by one selection period. The select signals $BL_1$ through $BL_4$ are shifted by one selection period as in the case of the select signals $SEL_1$ through $SEL_4$, and are never overlapped with the select signals $SEL_1$ through $SEL_4$ in each selection period.

In the OR circuit 501', a logical OR of an AND signal $ASB_1$ from the AND circuit 101' and AND signals $BSB_1$ through $DSB_1$ from the AND circuit corresponding to the 2nd through 4th bits in the same order of output as the AND circuit 101' is obtained.

The logical circuit groups 701 (signal output means) respectively includes EX-OR circuits 701*a*, AND circuits 701*b*, AND circuits 701*b'* and inverters 701*c*.

In each logical circuit group 701, by the EX-OR circuit 701*a*, a logical exclusive OR of output signals from the OR circuits 501 and 501' is obtained. By the AND circuit 701*b*, a logical AND of two output signals from the OR circuit 501 and the EX-OR circuit 701*a* is obtained, and the AND circuit 701*b'* ANDs two output signals from the OR circuit 501' and the EX-OR circuit 701*a*. The inverter 701*c* inverts an output signal from the EX-OR circuit 701*a*.

The analog switch array 2*b* includes a switch $ZSW_1$ in addition to switches $XSW_1$ and $YSW_1$. The switch $XSW_1$ is switched ON/OFF based on an output signal from the AND circuit 701*b*, and the switch $YSW_1$ is switched ON/OFF based on an output signal from the inverter 701*c*. Then, the switch $ZSW_1$ is switched ON/OFF based on an output signal from the AND circuit 701*b'*, and an erase voltage $V_{c2}$ is applied to the scanning electrode $L_1$.

Although not shown, the same arrangement is provided also for the 2nd through 4th. bits, and the application of the selection voltage $V_{c1}$, the non-selection voltage $V_{co}$ and the erase voltage $V_{c2}$ is performed also with respect to the scanning electrodes $L_2$ through $L_{15}$.

In the scanning driver 2 having the described arrangement, a logical product of the shift signal $ASR_i$ from the shift register 11 shown in FIG. 1 and the select signal $BL_1$ is obtained by the AND circuits 101' through 115' as follows:

$$ASR_i \times BL_1 = ASB_i.$$

The described logical AND is obtained also with respect to the shift signals $BSR_i$, $CSR_i$ and $DSR_i$ from the shift registers 12 through 14. As a result, AND signals $BSB_i$, $CSB_i$ and $DSB_i$ are outputted.

Thereafter, in the OR circuits 501 and 501', logical ORs of the AND signals $ASS_1$ through $DSS_1$, and the AND signals $ASB_1$ through $DSB_1$ are respectively obtained as follows.

$$ASS_1 + BSS_1 + CSS_1 + DSS_1 = SVS_1$$

$$ASB_1 + BSB_1 + CSB_1 + DSB_1 = SVB_1.$$

Figure 5:
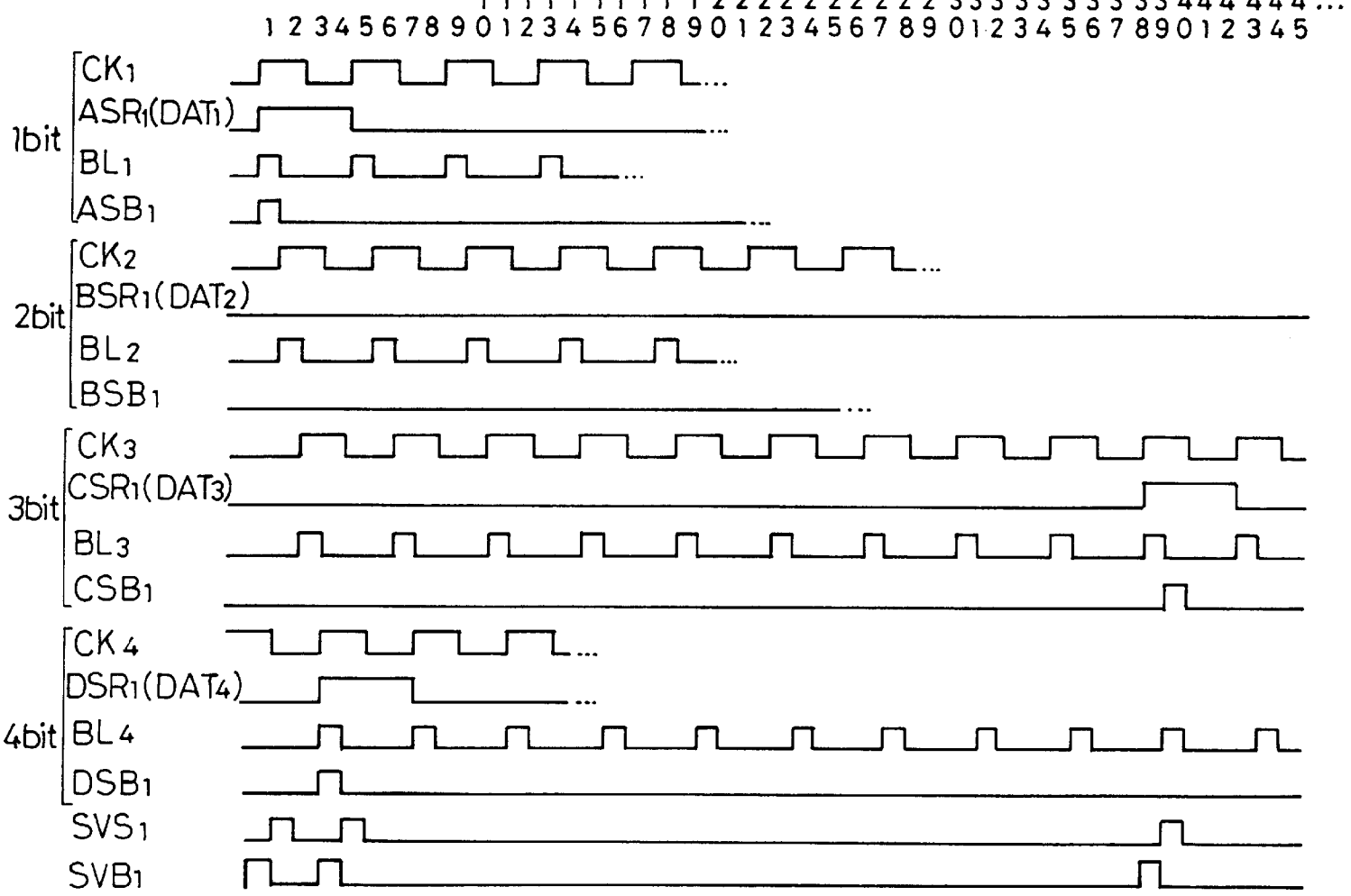
FIG. 5 is a time chart showing an operation of a voltage to be applied to a scanning electrode $L_1$ by the second scanning driver.

As a result, as shown in FIG. 5, the selection voltage use control signal $SVS_1$ and an erase voltage use control signal $SVB_1$ are outputted from the OR circuits 501 and 501'.

When the control signal $SVS_1$ is in the High level, the control signal $SVB_1$ is in the Low level. Here, a High level signal is outputted from the EX-OR circuit 701*a* and the AND circuit 701*b*, and a Low level signal is outputted from the AND circuit 701*b'* and the inverter 701*c*. Thus, the switch $XSW_1$ is switched ON, and the switches $YSW_1$ and $ZSW_1$ are switched OFF. As a result, the selection voltage $V_{c1}$ is outputted to the scanning electrode $L_1$ in the duration of the switch $XSW_1$.

When the control signal $SVB_1$ is in the High level, the control signal $SVS_1$ is in the Low level. Here, a High level signal is outputted from the EX-OR circuit 701*a* and the AND circuit 701*b'*, and a Low level signal is outputted from the AND circuit 701*b* and an inverter 701*c*. Thus, the switch $ZSW_1$ is switched ON, and the switches $XSW_1$ and $YSW_1$ are switched OFF. Thus, an erase voltage $V_{c2}$ is outputted to the scanning electrode $L_1$ in the duration of the switch $ZSW_1$.

When both the control signals $SVS_1$ and $SVB_1$ are in the High level or the Low level, the Low level signal is outputted from the EX-OR circuit 701*a* and the AND circuits 701*b* and 701*b'*, and a High level signal is outputted from the inverter 701*c*. As a result, the switch $YSW_1$ is switched ON, and the switches $XSW_1$ and $ZSW_1$ are switched OFF. Thus, the non-selection voltage $V_{co}$ is outputted to the scanning electrode $L_1$ in the duration of the switch $YSW_1$.

The described operation is performed also with respect to the scanning electrodes $L_2$ through $L_{15}$.

Figure 6:
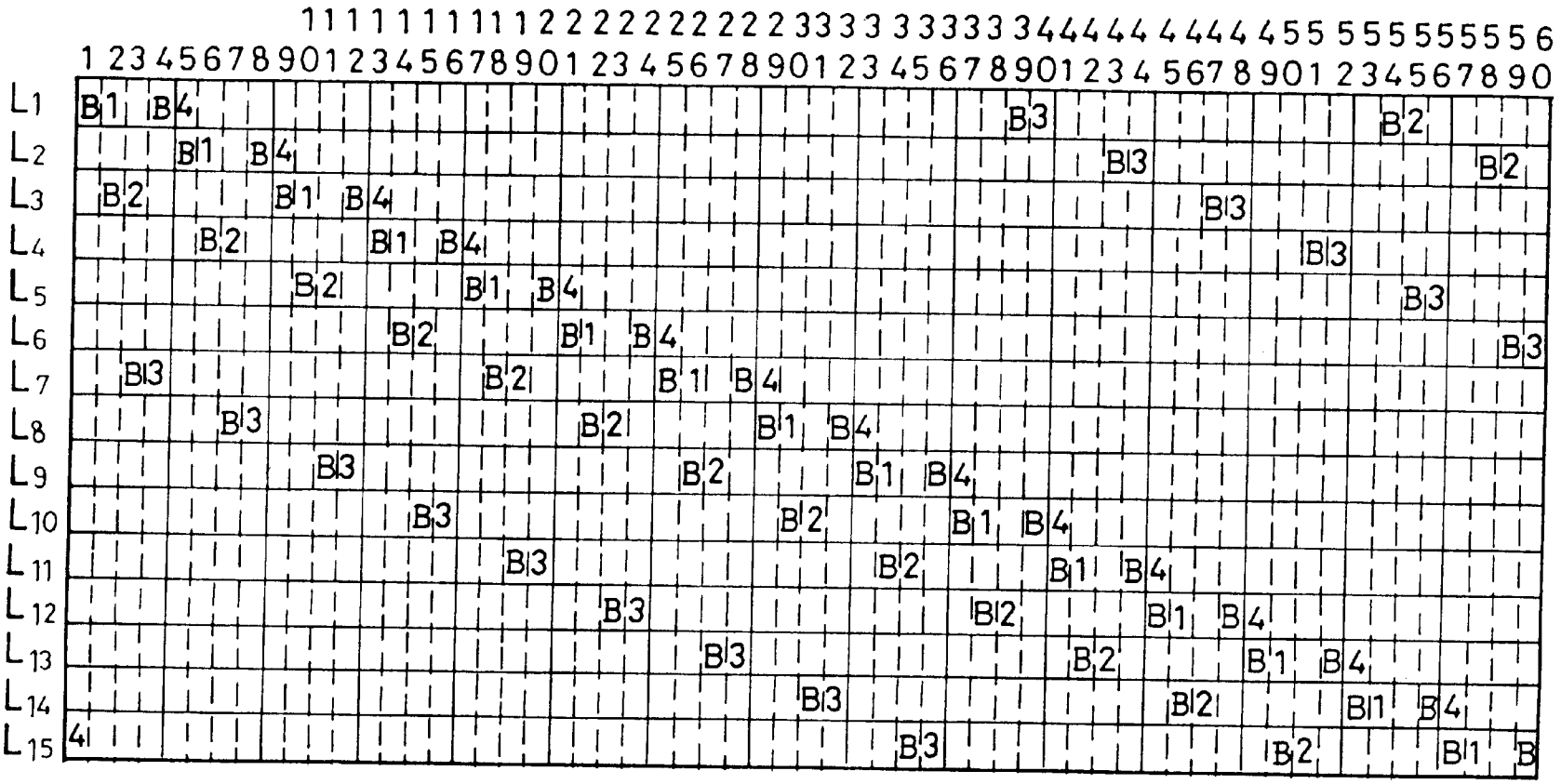
FIG. 6 is an explanatory view showing a scanning pattern by the second scanning driver.

As described, in the scanning driver 2, in the same scanning electrode $L_1$, a selection voltage is applied in a selection period directly after the selection period in which the erase voltage is applied. Thus, in the described operation, the scanning pattern is as shown in FIG. 6. Thus, in the described scanning pattern, the selection voltage is applied to the scanning electrode $L_i$ in a selection period directly after the selection period in which the erase voltage (shown by B in the figure) is applied, and data of each bit is displayed in a pixel on the scanning electrode $L_i$.

Thus, by adopting the scanning driver 2 in accordance with the present example, a complicated 4bit multiplex gray shades display including an erase voltage can be performed based on an input signal of a simple waveform.

Additionally, by increasing the number of the select signals, the potentials of the selection voltage and the erase voltage can be increased. However, in order to prevent a plurality of scanning electrodes $L_i$ from being selected simultaneously (such as a plurality of potentials are generated in the period in which the selection voltage is applied), it is required to apply the select signal to the control circuit 2*a*.

Third Scanning Driver

Figure 7:
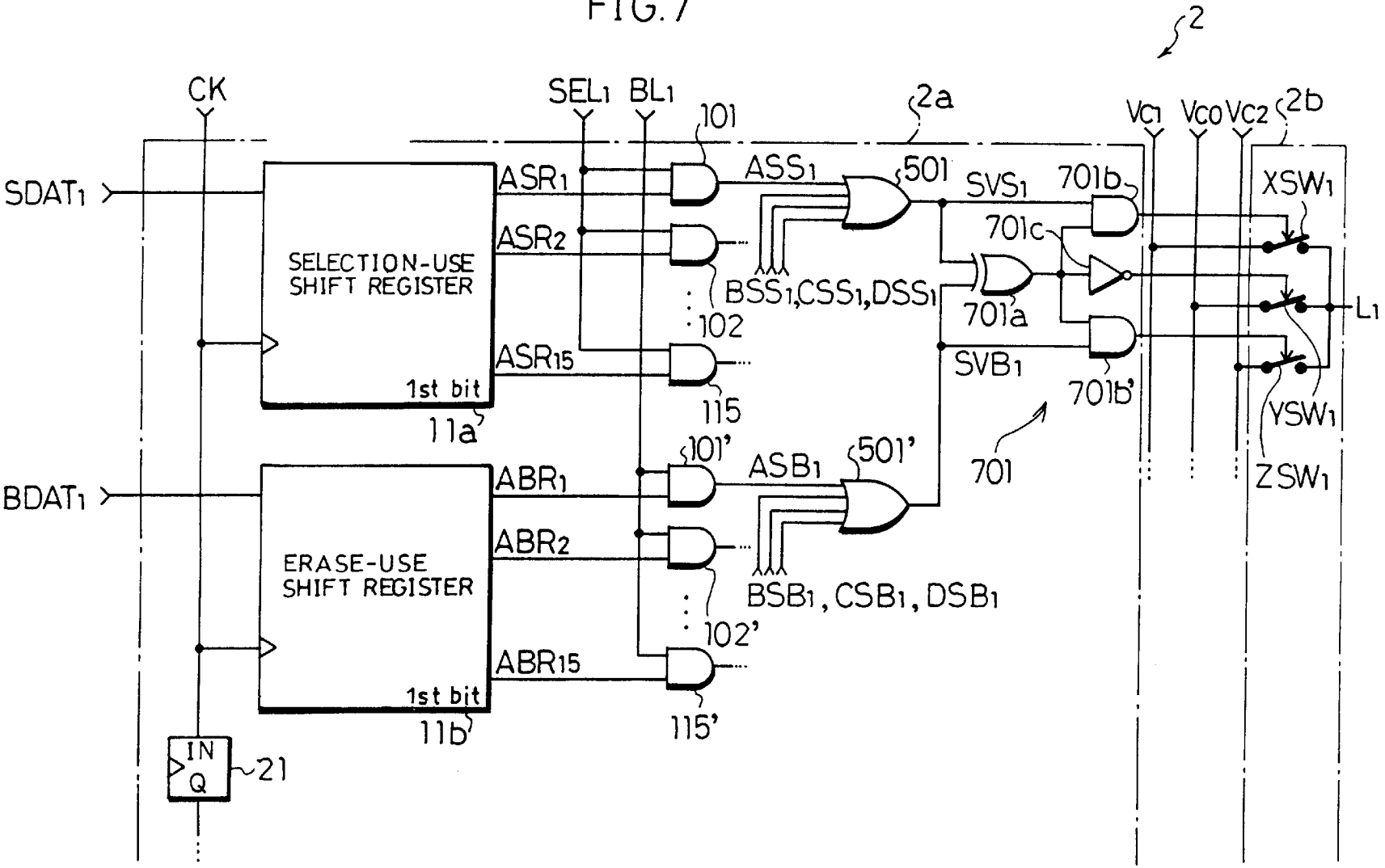
FIG. 7 is a circuit diagram showing a part of the structure of the third scanning driver in accordance with one embodiment of the present invention.

As shown in FIG. 7, the third scanning driver 2 differs from the second scanning driver 2 in that selection-use shift registers 11*a* through 14*a*, and erase-use shift registers 11*b* through 14*b* are provided in replace of the shift registers 11 through 14.

Although the selection-use shift registers 12*a* through 14*a* and the erase-use shift registers 12*b* through 14*b* corresponding to the second through fourth bits are omitted from in FIG. 7 for simplification, these shift registers have the same arrangements as the shift registers 11*a* and 11*b*.

To the selection-use shift register 11*a*, a selection-use bit data $SDAT_1$ is inputted, and an erase-use bit data $BDAT_1$ is inputted to the erase-use shift register 11*b*. To the shift registers 11*a* and 11*b*, the same clock CK is inputted.

By the AND circuits 101 through 115, logical ANDs of shift signals $ASR_1$ through $ASR_{15}$ from the selection-use shift register 11*a* and a select signal $SEL_1$ is obtained. By the AND circuits 101' through 115' (second logical product output means), a logical AND of shift signals $ABR_1$ through $ABR_{15}$ from the erase-use shift register 11*b* and a select signal $BL_1$ is obtained.

The described third scanning driver 2 have the same arrangement as the second scanning driver for the arrangement following the AND circuits 101 through 115, and 101' through 115'. Thus, the explanations thereof shall be omitted here.

In the scanning driver 2 having the described arrangement, a logical AND of the shift signals $ASR_1$ through $ASR_{15}$ from the selective shift register 11*a* and a select signal $SEL_1$ is obtained by the AND circuits 101 through 115 as follows:

$$ASR_1 \times SEL_1 = ASS_i.$$

In the described manner, the shift signals $BSR_i$, $CSR_i$ and $DSR_i$ from the selective-use shift registers 12*a* through 14*a* are also ANDed. As a result, AND signals $BSS_i$, $CSS_i$ and $DSS_i$ are also outputted.

On the other hand, the shift signal $ABR_1$ through $ABR_{15}$ from the erase-use shift register 11*b* and the select signal $BL_1$ are ANDed by the AND circuits 101' through 115'.

$$ABR_i \times BL_1 = ASB_i.$$

In the described manner, shift signals $BBR_i$, $CBR_i$ and $DBR_i$ from the erase-use shift registers 12*b* through 14*b* are also ANDed. As a result, AND signals $BSB_i$, $CSB_i$ and $DSB_i$ are outputted.

Thereafter, by the OR circuits 501 and 501', a logical OR of the AND signals $ASS_i$ through $DSS_i$ and the AND signals $ASB_i$ through $DSB_i$ is obtained in the same manner as the second scanning driver. As a result, a selection voltage use control signal $SVS_1$ and an erase-voltage use control signal $SVB_1$ are outputted from the OR circuits 501 and 501'.

As described, the third scanning driver 2 includes the selective-use shift register 11*a* (12*a* through 14*a*) and the erase-use shift register 11*b* (12*b* through 14*b*), and a shift signal to be ANDed to the select signal $SEL_i$, and the shift signal to be ANDed to the select signal $BL_i$ are obtained separately. As a result, in the case of the 4-bit multiplex gray shades display, an interval between the selection voltage and the erase voltage can be set as desired without being fixed like the second scanning driver (two selection periods at a maximum). Thus, an interval between the selection voltage and the erase voltage can be set larger than the interval between the selection voltage and the erase voltage to be outputted from the second scanning driver.

Fourth Scanning Driver

As shown in FIG. 1, the fourth scanning driver 2 has the same arrangement as the first scanning driver for the shift registers 11 through 14. As shown in FIG. 4, the circuits in and after the AND circuits 501 and 501' have the same arrangement as the second scanning circuit as shown in FIG. 8.

Figure 8:
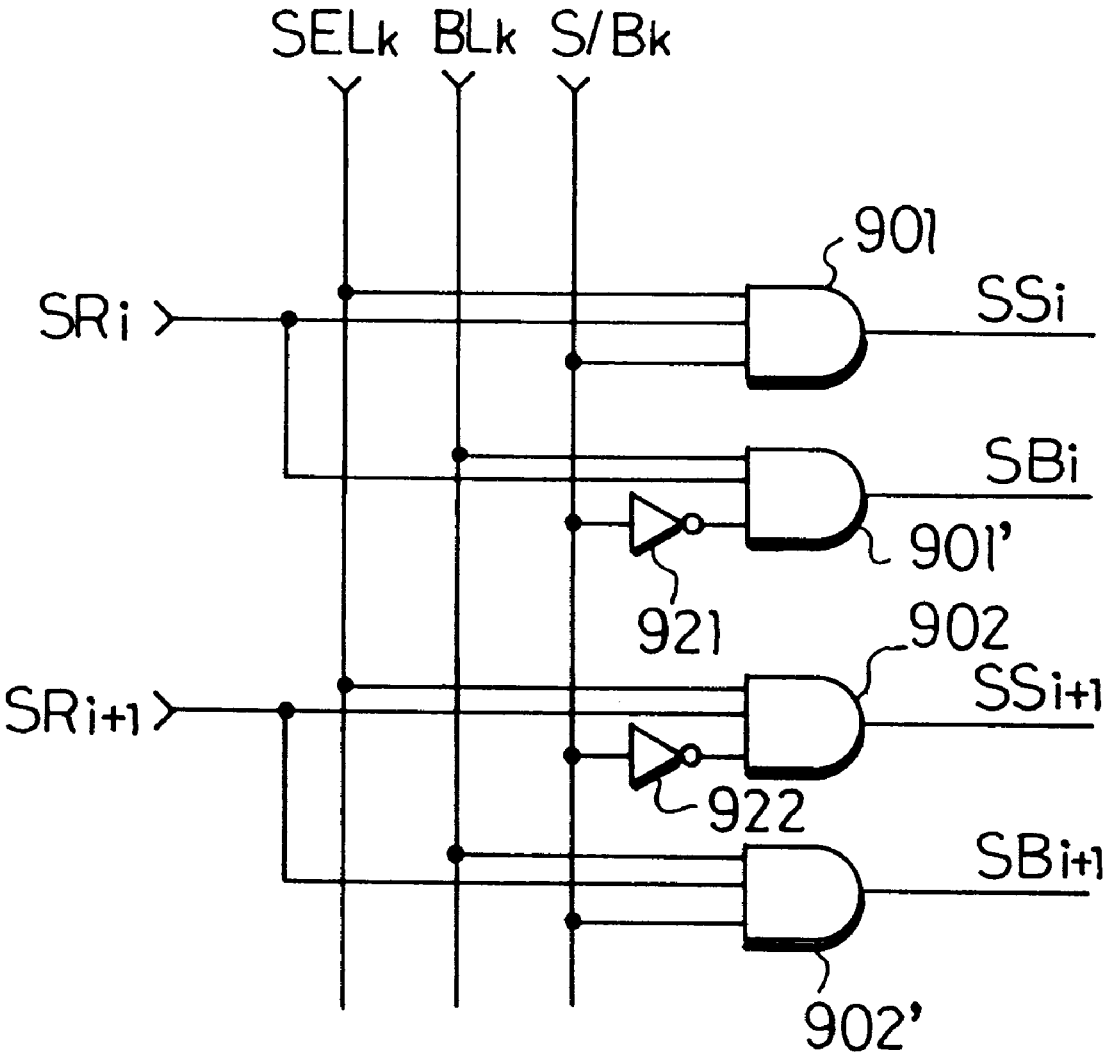
FIG. 8 is a circuit diagram showing a part of the structure of the fourth scanning driver in accordance with one embodiment of the present invention.

As shown in FIG. 8, the fourth scanning driver 2 includes AND circuits 901 and 902 (first logical product output means) and AND circuits 901' and 902' (second logical product output means), and inverters 921 and 922. For convenience, AND circuits 903 through 915, and 903' through 915' are omitted from the figure. The shift registers 11 through 14 are connected to the circuits respectively composed of AND circuits 903 through 915, and 903' through 915' and inverters 923 through 935.

In the AND circuits 901 and 903 in the order of odd number, a logical AND of shift signal $SR_i$(i is an odd number) in the order of an odd number of output from the shift registers 11 through 14, a select signal $SEL_k$ (k=1 through 4), and an identification signal $S/B_k$ (to be described later) is obtained. In the AND circuits 901' and 903' in the order of odd number, a logical AND of the shift signal $SR_i$, a select signal $BL_k$, and a NOT identification signal $\overline{S/B}_k$ which is a logical NOT of the identification signal $S/B_k$ from an inverter 921 is obtained.

In the AND circuits 902 and 904 in the order of even number, a logical AND of a shift signal $SR_{i+1}$ in the order of even number from the shift registers 11–14, a select signal $SEL_k$, and a NOT-identification signal $\overline{S/B}_k$ is obtained. In the AND circuits 902' and 904' in the order of even number, a logical AND of a shift signal $SR_{i+1}$ a select signal $BL_k$ and an identification signal $S/B_k$ is obtained.

In the described fourth scanning driver 2, a bit data DAT to be inputted to the shift registers 11 through 14 includes selection-use information and erase-use information in one frame. The bit data DAT is a signal for identifying pulses of two kinds in the identification signal $S/B_k$. The identification signal $S/B_k$ is a clock which has a period of 8 selection periods when the period of the selection-use pulse and an erase-use pulse of the bit data DAT is the period of multiples of an even number of 4 selection periods (basic selection period), while has a period of 12 selection periods when the period is a multiple of an odd number.

For the scanning driver 2 having the described arrangement, the shift signal $SR_i$ ($ASR_i$ through $DSR_i$) in the order of an odd number to be outputted from the shift registers 11 through 14, the select signal $SEL_k$ and the identification signal $S/B_k$ are ANDed by the AND circuit 901 (903 . . . ) having an order of an odd number as follows:

$$SR_i \times S/B_k \times SEL_k = SS_i.$$

A logical AND of the shift signal $SR_i$ in the order of an odd number, the select signal $BL_k$, and the NOT identification signal $S/B_k$ is obtained by the AND circuit 901' (903' . . . ) as follows:

$$SR_i \times \overline{S/B}_k \times BL_k = SB_i.$$

On the other hand, a logical AND of the shift signal $SR_{i+1}$ ($ASR_{i+1}$–$DSR_{i+1}$) in the order of an even number to be outputted from the shift registers 11 through 14, the select signal $SEL_k$, and the NOT identification signal $\overline{S/B}_k$ is obtained by the AND circuit 902 (904 . . . ) of an even number as follows:

$$SR_{i+1} \times \overline{S/B}_k \times SEL_k = SS_{i+1}.$$

A logical AND of the shift signal $SR_{i+1}$ in the order of an even number, the select signal $BL_k$, and the identification signal $S/B_k$ is obtained by the AND circuit 902' (904') of an even number as follows:

$$SR_{i+1} \times S/B_k \times BL_k = SB_{i+1}.$$

Figure 9:
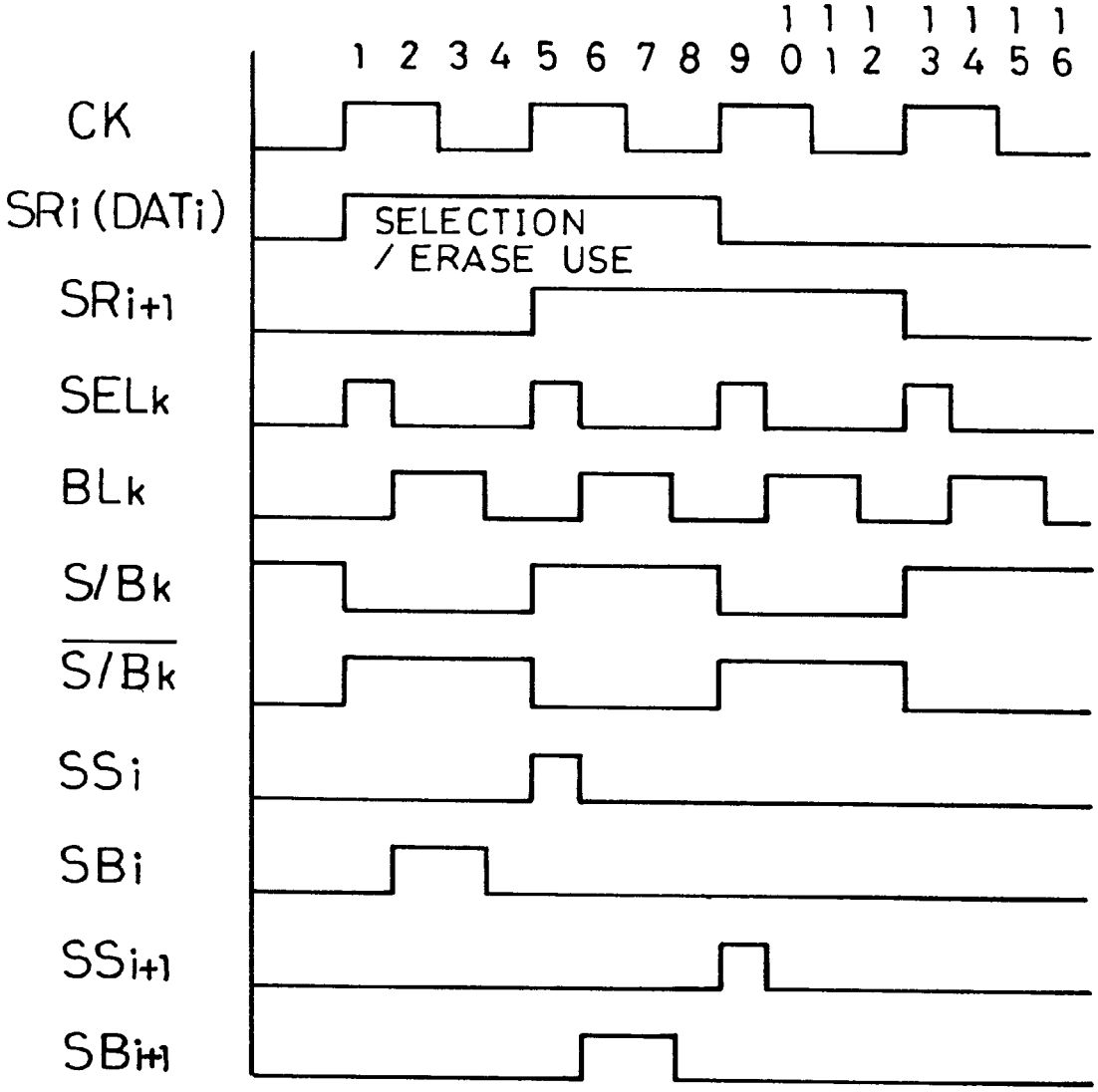
FIG. 9 is a time chart showing an operation of the fourth scanning driver.

Here, in the case shown in FIG. 9, selection-use and the erase-use information are contained in the same pulse of the bit data $DAT_i$, and the period (width) is eighth selection periods (two times of the basic selection period). The identification signal $S/B_k$ has the period of 8 selection periods. In this case, by obtaining a logical AND using one pulse of the bit data $DAT_i$, AND signals SS*i* and $SS_{i+1}$ of the selection-use AND signals and the erase-use AND signals $SB_i$ and $SB_{i+1}$ before the selection-use AND signals $SS_i$ and $SS_{i+1}$ is obtained.

Figure 10:
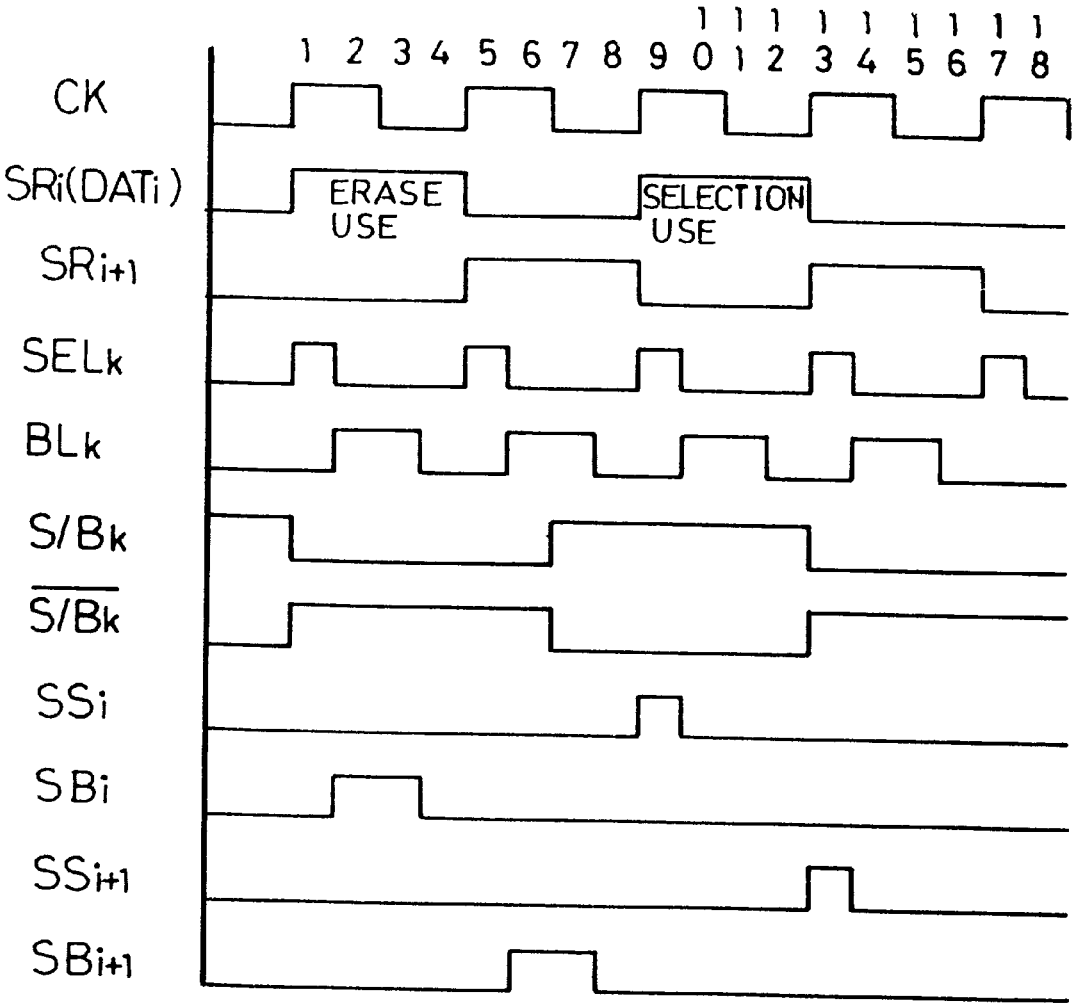
FIG. 10 is a time chart showing another operation of the fourth scanning driver.

In the case shown in FIG. 10, the selective-use information and the erase-use information are contained in different pulses in the bit data $DAT_i$, and the period (width) thereof is a four selection periods (equal to the basic selection period). The identification signal $S/B_k$ has a frequency of twelve selection periods. In this case, by obtaining a logical AND using two pulses of the bit data DATI, erase use AND signals $SB_i$ and $SB_{i+1}$ are obtained respectively one period before the selection-use AND signal $SS_i$ and $SS_{i+1}$, and the selection-use AND signals $SS_i$ and $SS_{i+1}$ are obtained.

The AND signal $SS_i$ obtained in the described manner no longer shows a difference between the order of an even number and the order of an odd number, and is treated in the same manner as the AND signal obtained by the third scanning driver. Thus, in the OR circuit 501, 501', logical ORs of the AND signals $ASS_i$ through $DSS_i$ and the AND signals $ASB_i$ through $DSB_i$ are obtained, thereby obtaining a selection-voltage use control signal $SVS_i$ and an erase voltage-use control signal $SVB_i$.

As described, in the fourth scanning driver 2, selective-use information and the erase-use information are contained in the bit data DAT to be applied to the shift registers 11 through 14. The outputs from the AND circuit are divided between the order of an odd number and an order of an even number to be ANDed separately, thereby obtaining a selection-use AND signal and an erase-use select signal. Thus, using the shift register having the same arrangement as the first scanning driver, an interval between the selection voltage and the erase voltage can be set as desired like the third scanning driver without increasing the number of the shift registers.

In the fourth scanning driver 2, as the respective phases of the clock CK, the select signal SEL and BL and the identification signal $S/B_k$ are shifted by one selection period for shift registers 11 through 14, the respective 4-bit selection voltages are not overlapped each other.

Fifth Scanning Driver

Figure 11:
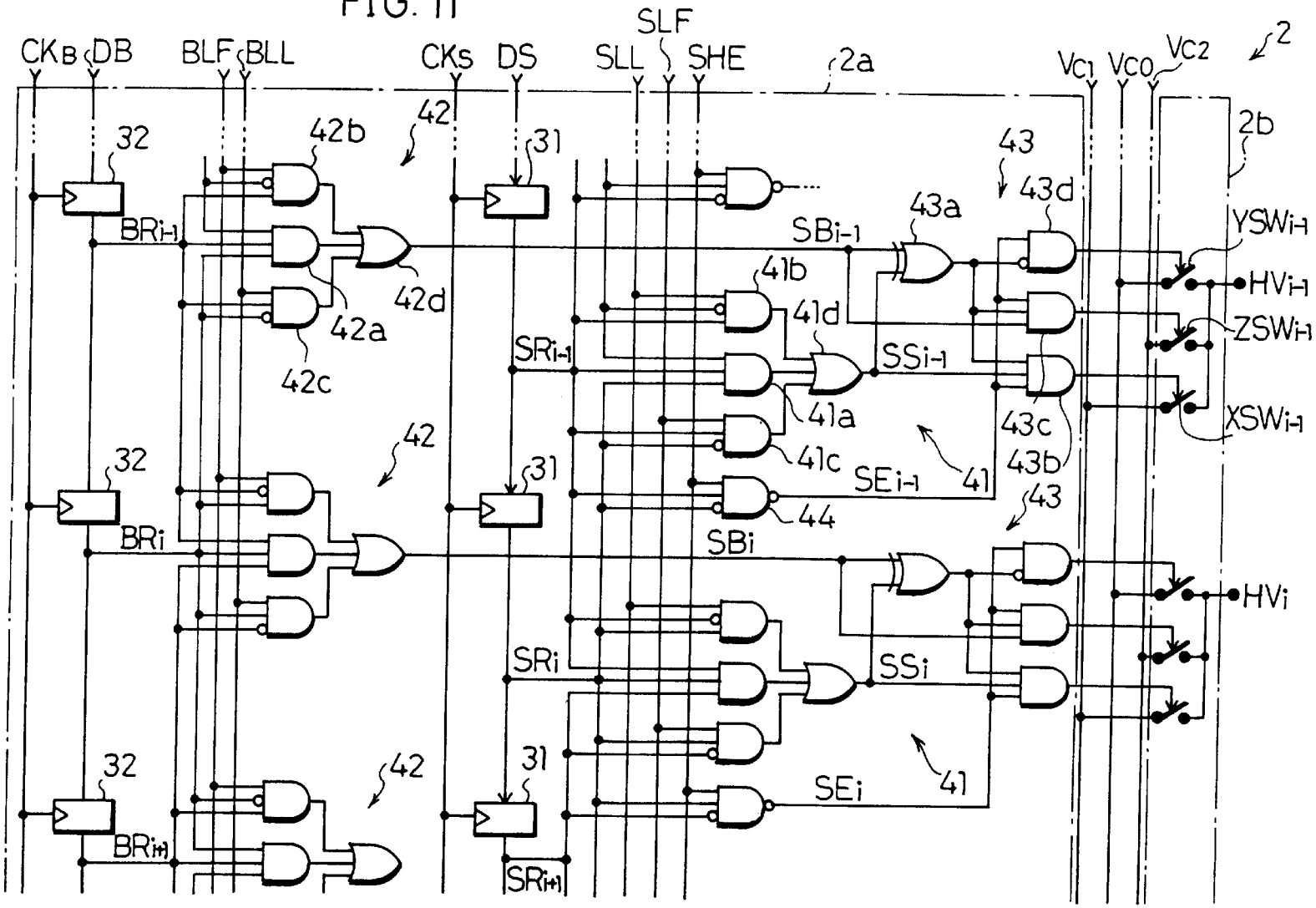
FIG. 11 is a circuit diagram showing a part of the structure of the fifth scanning driver in accordance with one embodiment of the present invention.

As shown in FIG. 11, in the fifth scanning driver 2, the control circuit 2*a* includes flip flops 31, flip flops 32, logical circuit groups 41, logical circuit groups 42, logical circuit groups 43 and NAND circuits 44. In FIG. 11, the structure for three stages of the shift register are shown.

To the scanning driver 2, the select signal SLF assigned to the first selection period and the select signal SLL assigned to the last selection period are inputted as select signals among three successive selection periods. To the scanning driver 2, the select signal BLF assigned to the first selection period and the select signal BLL assigned to the last selection period are inputted as erase-use signals among three successive selection periods. Further, to the scanning driver 2, a high impedance signal SHE is inputted.

Figure 12:
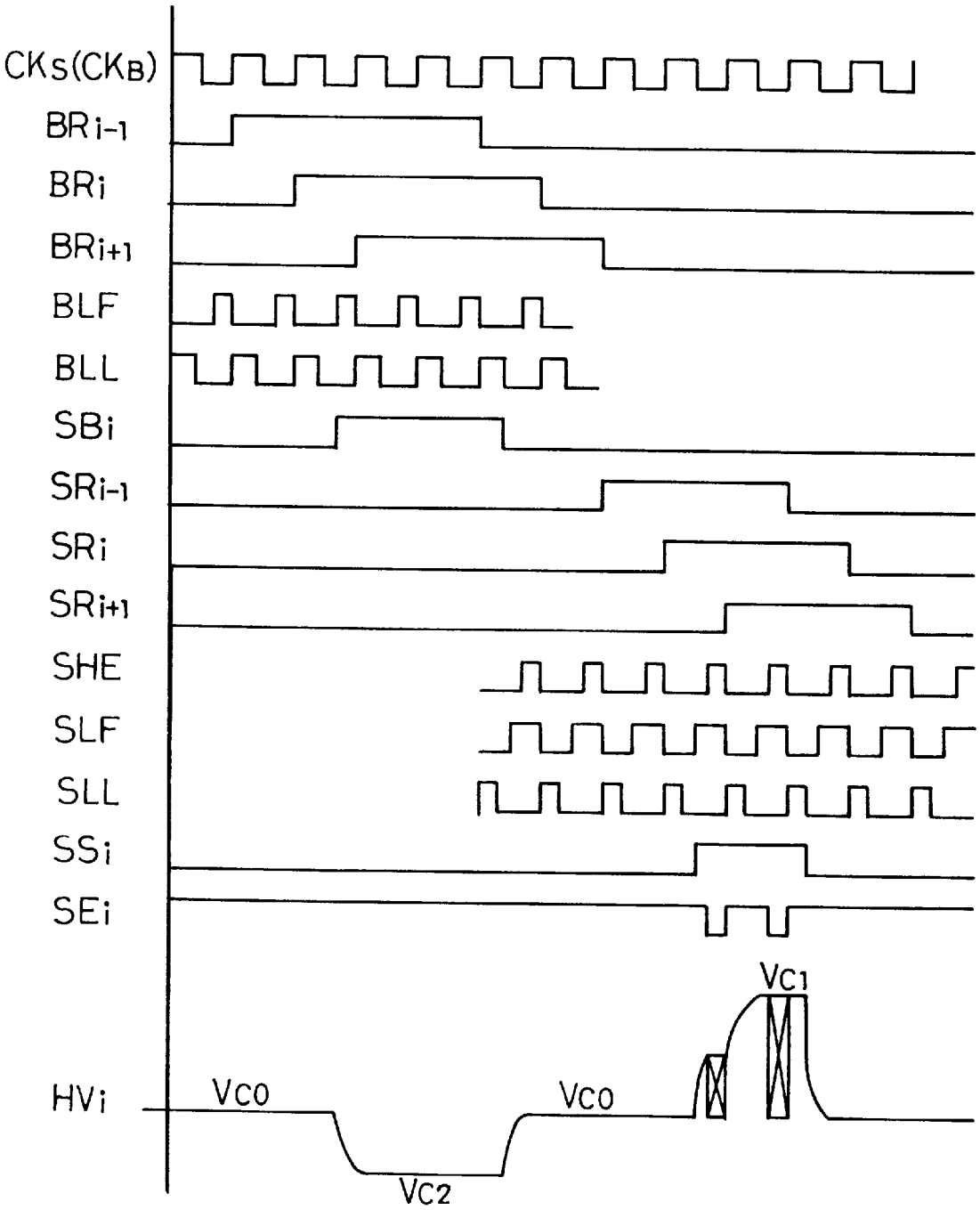
FIG. 12 is a time chart showing an operation of the fifth scanning driver.

The flip flops 31 constitute the selection-use shift register, and shifts in order the bit data DS having a period of not less than two times of the clock $CK_s$ shown in FIG. 12 in sync with the clock $CK_s$. On the other hand, the flip flops 32 constitute the erase-use shift register, and shifts in order the bit data DB having a period of not less than two times of the clock $CK_B$ in sync with the clock $CK_B$.

Although the clocks $CK_s$ and $CK_B$ have the same period, the respective phases thereof may be different from each other.

The logical circuit group 41 includes AND circuits 41*a* through 41*c*, and the OR circuit 41*d*, which have three input terminals. The AND circuit 41*a* (first logical product output means) is connected to three adjoining flip flops 31.

The AND circuits 41*b* and 41*c* respectively have single NOT inputs. The NOT input of the AND circuit 41*b* is connected to the flip flop 31 of the first stage among three flip flops 31. The NOT input of the AND circuit 41*c* is connected to the flip flop 31 of the last stage among three flip flops 31.

The AND circuit 41*b* (third logical product output means) is connected to first two flip flops 31 among three flip flops 31 and the supply line of the select signal SLL. The AND circuit 41*c* (second logical product output means) is connected to last two flip flops 31 among three flip flops 31 and the supply line of the select signal SLF.

The OR circuit 41*d* (first logical sum output means) is connected to respective outputs of the AND circuits 41*a* through 41*c*.

The logical circuit group 42 is composed of AND circuits 42*a* through 42*c*, and an OR circuit 42*d*, which have three inputs. The AND circuit 42*a* (fourth logical product output means) is connected to the adjoining three flip flops 32. The AND circuits 42*b* and 42*c* respectively have single negation inputs, and are arranged such that a signal is inputted in different combinations for each logical circuit group.

The AND circuit 42*b* (fifth logical product output means) is connected to the first two flip flops 32 among three flip flops 32 connected to the AND circuit 42*a* and the supply line of the select signal BLF. The AND circuit 42*c* (sixth logical product output means) is connected to the last two flip flops 32 among three flip flops and the supply line of the select signal BLL. The OR circuit 42*d* is connected to the output of the AND circuits 42*a* through 42*c*.

The NAND circuit 44 (OFF means) is connected to the last two flip flops 31 among three flip flops and the supply line of the high impedance signal SHE. However, in the NAND circuit 44, the input to be connected to the last flip flop 31 among the three flip flops is a NOT input.

The logical circuit group 43 (signal output means) is composed of EX-OR circuit 43*a*, and AND circuits 43*b* through 43*d*. The EX-OR circuit 43*a* is connected to the output of the OR circuit 41*d* and 42*d*. The AND circuits 43*b* through 43*d* are respectively connected to the output of the NAND circuit and the output of the EX-OR circuit 43*a*. However, one of the inputs of the AND circuit 43*d* is a NOT input. The AND circuit 43*b* is connected to the output of the OR circuit 41*d*, and the AND circuit 43*c* is connected to the output of the OR circuit 42*d*.

An operation of the scanning driver 2 having the described arrangement will be explained in reference to a time chart shown in FIG. 12.

When the bit data DS is shifted in order by the flip flops 31, shift signals $SR_{i-1}$, $SR_i$ and $SR_{i+1}$ corresponding to three adjoining scanning electrodes $L_{i-1}$, $L_i$ and $L_{i+1}$ (not shown) are outputted. In the logical circuit group 41, using the shift signals $SR_{i-1}$, $SR_i$and $SR_{i+1}$ and select signals SLF and SLL, a logical operation is performed as follows:

$$(SR_{i-1}\times SR_i\times SLF)+(SR_{i-1}\times SR_i\times SR_{i-1})+(SR_i\times SR_{i+1}\times SLL)=SS_i.$$

As a result, a control signal $SS_i$ for selection voltage corresponding to the scanning electrode $L_i$ is obtained.

On the other hand, when the bit data DB is shifted by the flip flops 32 in order, shift signals $BR_{i-1}$, $BR_i$ and $BR_{i+1}$ corresponding to the scanning electrodes $L_{i-1}$, $L_i$ and $L_{i+1}$, are outputted. In the logical circuit group 42, using the shift signals $BR_{i-1}$, $BR_i$ and $BR_{i+1}$, and the select signals BLF and BLL, a logical operation is performed as follows:

$$(BR_{i-1}\times BR_i\times BLF)+(BR_{i-1}\times BR_i\times BR_{i+1})+(BR_i\times BR_{i+1}\times BLL)=SB_i.$$

As a result, an eraser voltage use control signal $SB_i$ corresponding to the scanning electrode $L_i$ is obtained.

In the NAND circuit 44, using the shift signals $SR_i$ and $SR_{i+1}$ and the high impedance signal SHE, a logical computation is performed as follows:

$(SR_i\times SR_{i+1}\times SHE)=SE_i$. As a result, a voltage application interruption-use control signal $SE_i$ corresponding to the scanning electrode $L_i$ is obtained.

In the logical circuit group 43, a logical operation is performed using the resulting control signals $SS_i$, $SB_i$ and $SE_i$.

As a result, when the control signals $SS_i$ and $SE_i$ are in the High level, and the control signal $SB_i$ is in the Low level, the switch $XSW_i$ is switched ON, and the switch $ZSW_i$ is switched OFF. As a result, a selection voltage $V_{c1}$ is outputted as an output voltage $HV_i$ of the fifth scanning driver 2. On the other hand, when the control signals $SB_i$ and $SE_i$ are in the High level, and the control signal $SS_i$ is in the Low level, the switch $ZSW_i$ is switched ON, and the switch $XSW_i$ is switched OFF, thereby outputting an erase voltage $V_{c2}$. The switch $YSW_i$ is in the OFF state in both of the described case.

When the control signals $SS_i$, $SB_i$ and $SE_i$ are all in the Low level, the switches $XSW_i$ and $ZSW_i$ are switched OFF, and the switch $YSW_i$ is switched ON, and a non-selection voltage $V_{co}$ is outputted.

As described, in the fifth scanning driver 2, adjoining two control signals SS can be switched to the High level in the same selection period based on a combination of AND of three shift signals $SR_{i-1}$, $SR_i$ and $SR_{i+1}$ to be outputted sequentially, and select signals SLF and SLL. Further, based on a combination of AND of three shift signals $BR_{i-1}$, $BR_i$ and $BR_{i+1}$, and select signals BLF and BLL, the two adjoining control signals SB can be set in the High level in the same selection period.

Thus, a voltage can be applied to the same scanning electrode $L_i$ over two selection periods.

On the other hand, in the scanning driver 2, when the control signal $SE_i$ is in the Low level, the switches $XSW_i$, $YSW_i$ and $ZSW_i$ are switched OFF. Here, as the output terminal of the scanning driver 2 is in the high impedance, the voltage is not outputted from the scanning driver 2. As the liquid crystal panel 1 which is the load of the fifth scanning driver 2 is a capacitive load, in the state of the high impedance, the charge held in the capacitive load is maintained with ease without being discharged. Therefore, the voltage directly before the output terminal becomes high impedance can be maintained.

In the liquid crystal panel 1 (capacitive load), even when the switch $YSW_i$ is switched from the ON position to the OFF position, and the switch $XSW_i$ is switched from the OFF position to the ON position, the voltage of the output terminal will not reach the selection voltage $V_{c1}$ soon, and reaches the $V_{c1}$ over several $\mu$s.

As shown in FIG. 12, by switching OFF the switch $XSW_i$ while the output voltage $HV_i$ is switched from the non-selection voltage $V_{co}$ to the selection voltage $V_{c1}$, the voltage is maintained while the switch $XSW_i$ is maintained in the OFF position. As a result, a voltage level as desired from the non-selection voltage $V_{co}$ to the selection voltage $V_{c1}$ can be applied to the liquid crystal panel 1.

Even if the control signal $SB_i$ is in the High level, by switching OFF the switch $ZSW_i$, a voltage of a level as desired between the non-selection voltage $C_{co}$ and the erase voltage $V_{c2}$ can be applied to the liquid crystal panel 1.

Additionally, the arrangement for setting the output stage to the high impedance can be applied to the second through fourth scanning drivers including the AND circuit in the output stage of the control circuit 2*a*. In this case, the AND circuit having two inputs of the output stage are replaced by the AND circuit having three inputs so as to permit an input of the high impedance signal SHE.

SECOND EMBODIMENT

Figure 13:
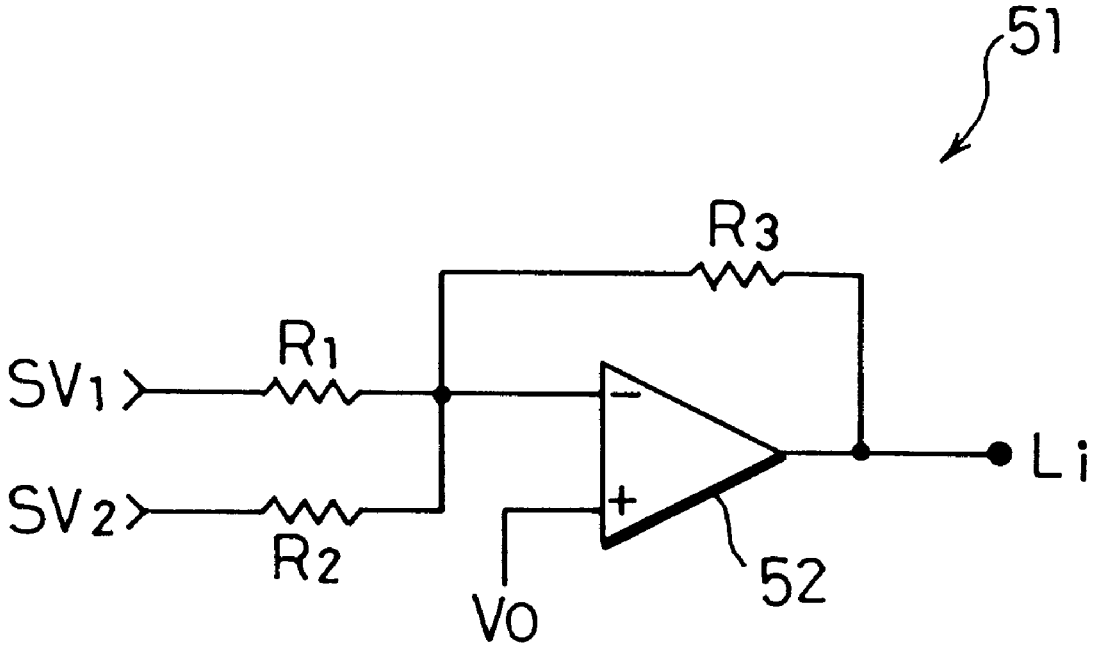
FIG. 13 is a circuit diagram showing a part of the structure of the scanning driver in accordance with another embodiment of the present invention.

Another embodiment of the present invention will be explained in reference to FIG. 13.

The present embodiment has the same configuration as the first embodiment up to the OR circuits 501 and 501' adopted in the second or the third scanning drivers (see FIG. 4 or FIG. 7). In the present embodiment, a circuit after the OR circuits 501 and 501' is replaced by an inversion amplifier circuit 51 shown in FIG. 13.

The inversion amplifier 51 includes an operational amplifier (hereinafter simply referred to as an OP amplifier) 52, and resistors $R_1$ through $R_3$. To the inversion input terminal of an operational amplifier 52, a signal $SV_1$ is inputted through the resistor $R_1$, and a signal $SV_2$ through a resistor $R_2$ connected in parallel to the resistor $R_1$. To the non-inversion input terminal of the OP amplifier 52, a reference voltage $V_0$ of 10 V is inputted. The output terminal of the OP amplifier 52 is connected to the scanning electrode $L_i$, and is connected to the inverse input terminal via the resistor $R_3$.

The signals $SV_1$ and $SV_2$ are signals corresponding to the control signals $SVS_i$ and $SVB_i$ in the second scanning driver. In the scanning driver 2 adopted in this embodiment, such signals are used as control signals irrespectively of the selection use and erase use, and thus, the signals are denoted simply as signals $SV_1$ and $SV_2$.

In the scanning driver of the present embodiment, the selection voltage is selected to be 10V and 5V, and the erase voltage is selected to be −5V, and the non-selection voltage is selected to be 0V. For this reason, the resistance values $R_1$, $R_2$ and $R_3$ are respectively set to $R_0$, $R_0/2$ and $R_0$. The signals $SV_1$ and $SV_2$ in "High" and "Low" level are respectively set to $V_0$(10V) and $V_s$(15V)

In the scanning driver having the described arrangement, the output voltage $V_{out}$ of the OP amplifier 52 is obtained by the following formula:

$$V_{out}=(V_0-V_s)R_0\Sigma(P_m/R_m)+V_o,$$

wherein $P_m$ show the logical state of the signal $SV_m$ is either "0" or "1", $R_m$ is a respective resistance value of each resistor in the circuit, and $\Sigma(P_m/R_m)$ is a sum of $P_m/R_m$.

For example, when the signal $SV_1$ is in the "High" level", and the signal $SV_2$ is in the "Low level", the output voltages $V_{out}$ of the OP amplifier 52 are $V_0$=10 V, $V_S$=15V, $P_1$=1, and $P_2$=0. Thus, $$V_{out}=(10-15)R_0(1/R_0+0/R_0/2)+10=5V.$$

As described, in the scanning driver of the present embodiment, by combining the values of signals $SV_1$ and $SV_2$ (logical values) as shown in Table 1, four voltages, i.e., two selection voltages, non-selection voltage and erase voltage can be obtained. As can be seen from Table 1, irrespectively of two input signals, a voltage of 4 kinds (=$2^2$) are outputted as output signals.

TABLE 1

| $SV_1$ | $SV_2$ | $V_{out}$ |
|---|---|---|
| L | L | 10 V (selection voltage) |
| H | L | 5 V (selection voltage) |
| L | H | 0 V (non-selection voltage) |
| H | H | −5 V (erase voltage) |

In the arrangement adopting the analog switch array like each scanning driver in the first embodiment, as the number of control signals and switches controlled by the control signal increase, it is likely that the circuit becomes larger in size. In contrast, according to the scanning driver of the present embodiment, the kind of the voltage to be applied to the scanning electrode $L_i$ can be increased without increasing the number of signals. Thus, by adopting the scanning driver of the present embodiment, the circuit can be reduced in size compared with the scanning driver adopting the analog switch array.

In the present invention, the number of signals to be inputted to the scanning driver is selected to be two; however, only one or three or more of signals may be adopted. In the case of adopting only one signal, the described structure can be applied to the first scanning driver in the first embodiment, and the control signal SVS is inputted to the OP amplifier through the resistor. In the case of adopting three signals, the described structure can be applied to the fifth scanning driver in the first embodiment, and the control signals $SS_i$, $SB_i$ and $SE_i$ are inputted to the OP amplifier respectively through different resistors.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the instant contribution to the art and, therefore, such adaptations should and are intended to be comprehended within the meaning and range of equivalence of the appended claims.

What is claimed is:

1. A drive circuit for a matrix-type display apparatus, comprising:

n shift registers for outputting shift signals in the same number as scanning electrodes by shifting a data signal having a width of n selection periods (n is an integer of not less than 2) in sync with a clock having a period of n selection periods;

first logical product output means for obtaining a logical AND of a shift signal and one of n select signals having a constant period for determining a selection voltage application period, said first logical product output means being provided in the same number as the shift signals for each of said n shift registers; and first logical sum output means for obtaining a logical OR of logical ANDs based on shift signals which are in the same order of output respectively from said n shift registers, wherein the clock and the select signal are inputted in phase shifted by one selection period for each shift register.

2. The drive circuit for a matrix-type display apparatus as set forth in claim 1, further comprising:

second logical product output means for obtaining a logical AND of one of n blank signals having a constant period for determining an erase voltage application period and the shift signal, said second logical product output means being provided in the same number as the shift signals for each shift register; and second logical sum output means for obtaining a logical OR of logical ANDs obtained from said second logical product output means based on shift signals which are in the same order of output respectively from said n shift registers, wherein said blank signals are inputted in phase shifted by one selection period for each shift register in such a manner that a significant period thereof is not overlapped with that of the select signals.

3. The drive circuit for a matrix-type display apparatus as set forth in claim 2, further comprising:

signal output means for outputting three signals, only one of which becomes significant, based on logical ORs from said first logical sum output means and said second logical sum output means; and a selection voltage switch, a non-selection voltage switch, and an erase voltage switch which are controlled ON/OFF respectively by said three signals, and are switched ON when said three signals are significant respectively, whereby a selection voltage, a non-selection voltage and an erase voltage are outputted to said scanning electrodes.

4. The drive circuit for a matrix-type display apparatus as set forth in claim 3, further comprising:

OFF means for switching off said selection voltage switch when the signal applied thereto is significant.

5. The drive circuit for a matrix-type display apparatus as set forth in claim 3, further comprising:

OFF means for switching OFF said erase voltage switch when the signal applied thereto is significant.

6. The drive circuit for a matrix-type display apparatus as set forth in claim 2, further comprising:

a reversal amplifier for amplifying a difference between a sum of voltage based on respective logical ORs from said first logical sum output means and said second logical sum output means to be inputted to a reversal input terminal and a reference voltage to be inputted to a non-reversal input terminal at a predetermined amplification degree.

7. A drive circuit for a matrix-type display apparatus, comprising:

n selection shift registers for outputting selection shift signals in the same number as scanning electrodes by shifting selection data signals having a width of n selection periods (n is an integer of not less than 2) in sync with a clock having a period of n selection periods;

n erase shift registers for outputting erase shift signals obtained by shifting erase data signals indicative of information different from that of the selection data signals in the same manner as said selection shift registers, the erase data signals having the same width as the selection data signals;

first logical product output means for obtaining a logical AND of one of n select signals having a constant period for determining a selection voltage application period and the selection shift signals, said first logical AND output means being provided in the same number as the selection shift signals for each pair of the selection shift register and the erase shift register;

second logical product output means for obtaining a logical AND of one of n blank signals having a constant period for determining an erase voltage application period and the erase shift signals, said second logical product output means being provided in the same number as the erase shift signals for each pair of the selection shift register and the erase shift register;

first logical sum output means for obtaining a logical OR of logical ANDs obtained from said first logical product output means based on selection shift signals which are in the same order of output respectively from said n selection shift registers; and second logical sum output means for obtaining a logical OR of logical ANDs obtained from said second logical product output means based on erase shift signals which are in the same order of output respectively from said n erase shift registers, wherein the n blank signals are inputted in such a manner that the significant period thereof is not overlapped with that of the n select signals, and the clock, the n select signals and the n blank signals are inputted in phase shifted by one selection period for each pair of the selection shift register and the erase shift register.

8. The drive circuit for a matrix-type display apparatus as set forth in claim 7, comprising:

signal output means for outputting three signals, only one of which becomes significant, based on logical ORs from said first logical sum output means and said second logical sum output means; and a selection voltage switch, a non-selection voltage switch, and an erase voltage switch which are controlled ON/OFF respectively by said three signals, and are switched ON when said three signals are significant respectively, whereby a selection voltage, a non-selection voltage and an erase voltage are outputted to said scanning electrodes.

9. The drive circuit for a matrix-type display apparatus as set forth in claim 8, further comprising:

OFF means for switching OFF said selection voltage switch when a signal applied thereto is significant.

10. The drive circuit for a matrix-type display apparatus as set forth in claim 8, further comprising:

OFF means for switching off said erase voltage switch when the signal applied thereto is significant.

11. The drive circuit for a matrix-type display apparatus as set forth in claim 7, further comprising:

a reversal amplifier for amplifying at a predetermined amplification degree a difference between a sum of voltage based on respective logical ORs from said first logical sum output means and said second logical sum output means to be inputted to a reversal input terminal and a reference voltage to be inputted to a non-reversal input terminal.

12. A drive circuit for a matrix-type display apparatus, comprising:

n shift registers for outputting shift signals in the same number as scanning electrodes by shifting data signals containing two kinds of information having a width of an integer multiple of n selection periods (n is an integer of not less than 2) in sync with a clock having a period of the n selection periods;

first logical product output means for obtaining a logical AND of one of n select signals having a constant period for determining a selection voltage application period, a shift signal and an identification signal for identifying information contained in the data signals, said first logical product output means being provided in the same number as shift signals for each shift register;

second logical product output means for obtaining a logical product of one of n blank signals having a constant period for determining an erase voltage application period, a shift signal and an identification signal, said second logical product output means being provided in the same number as the shift signals per shift register;

logical negation input means for negating an input state of the identification signal between said first logical product output means and said second logical product output means against each order, and between respective orders of even number and orders of odd number against each other of said first logical product output means and said second logical product output means;

first logical sum output means for obtaining a logical OR of logical ANDs obtained from said first logical product output means based on shift signals which are in the same order of output respectively from said n shift registers; and second logical sum output means for obtaining a logical OR of logical ANDs obtained from said second logical product output means based on the shift signals which are in the same order of output respectively from said n shift registers, wherein the clock signal, the select signals and the blank signals are inputted at phase shifted by one selection period for each shift register, while the identification signal is a clock having a period of 2n selection periods when the width of the data signal is 'n' multiplied by an even number, while having a period of 3n selection periods when the width of the data signal is 'n' multiplied by an odd number.

13. The drive circuit for a matrix-type display apparatus as set forth in claim 12, comprising:

signal output means for outputting three signals, only one of which becomes significant, based on logical ORs from said first logical sum output means and said second logical sum output means; and a selection voltage switch, a non-selection voltage switch, and an erase voltage switch which are controlled ON/OFF respectively by said three signals, and are switched ON when said three signals are significant respectively, whereby a selection voltage, a non-selection voltage and an erase voltage are outputted to said scanning electrodes.

14. The drive circuit for a matrix-type display apparatus as set forth in claim 13, further comprising:

OFF means for switching off said selection voltage switch when a signal applied thereto is significant.

15. The drive circuit for a matrix-type display apparatus as set forth in claim 13, further comprising:

OFF means for switching off said erase voltage switch when a signal applied thereto is significant.

16. The drive circuit for a matrix-type display apparatus as set forth in claim 12, further comprising:

a reversal amplifier for amplifying a difference between a sum of voltages based on respective logical ORs from said first logical sum output means and said second logical sum output means to be inputted to a reversal input terminal and a reference voltage to be inputted to a non-reversal input terminal at a predetermined amplification degree.

17. A drive circuit for a matrix-type display apparatus, comprising:

selection shift registers for outputting a selection shift signals in the same number as scanning electrodes by shifting a selection data signal having a width of not less than two periods of a clock in sync with the clock;

first logical product output means for obtaining a logical AND of selection shift signals outputted from three adjoining output terminals of the selection shift registers;

second logical product output means for obtaining a logical AND of selection shift signals, which are respectively first and second in order of output among three selection shift signals, and a first select signal having a constant period for determining a selection voltage application period when the selection voltage is first applied to a specific one of three adjoining scanning electrodes;

third logical product output means for obtaining a logical AND of selection shift signals which are respectively second and third in order of output among the three selection shift signals and a second select signal having a constant period for determining a selection voltage application period when applying the selection voltage last to the specific scanning electrode; and first logical sum output means for obtaining a logical OR of logical ANDs from said first logical product output means, said second logical product output means, and said third logical product output means.

18. The drive circuit for a matrix-type display apparatus as set forth in claim 17, further comprising:

erase shift registers for outputting erase shift signals in the same number as the scanning electrodes by shifting erase data signals in phase different from that of the selection data signal in sync with the clock, the erase data signal having a width of not less than two periods of the clock;

fourth logical product output means for obtaining a logical AND of the erase shift signals outputted from three adjoining output terminals of the erase shift registers;

fifth logical product output means for obtaining a logical product of the erase shift signals which are first and second in order of output among the three erase shift signals and a first blank signal having a constant period for determining an erase voltage application period when the erase voltage is first applied to the specific scanning electrode;

sixth logical product output means for obtaining a logical AND of the erase shift signals which are second and third in order of output among three erase shift signals and a second blank signal having a constant period for determining the erase voltage application period when the erase voltage is applied last to the specific scanning electrode; and second logical sum output means for obtaining a logical OR of the logical ANDs from the fourth through sixth logical product output means.

19. The drive circuit for a matrix-type display apparatus as set forth in claim 18, further comprising:

signal output means for outputting three signals, only one of which becomes significant, based on logical ORs from said first logical sum output means and said second logical sum output means; and a selection voltage switch, a non-selection voltage switch, and an erase voltage switch which are controlled ON/OFF respectively by said three signals, and are switched ON when said three signals are significant respectively, whereby a selection voltage, a non-selection voltage and an erase voltage are outputted to said scanning electrodes.

20. The drive circuit for a matrix-type display apparatus as set forth in claim 19, further comprising:

OFF means for switching off said selection voltage switch when a signal applied thereto is significant.

21. The drive circuit for a matrix-type display apparatus as set forth in claim 19, further comprising:

OFF means for switching off said erase voltage switch when the signal applied thereto is significant.

22. The drive circuit for a matrix-type display apparatus as set forth in claim 18, further comprising:

a reversal amplifier for amplifying at a predetermined amplification degree a difference between a sum of voltage based on respective logical ORs from said first logical sum output means and said second logical sum output means to be inputted to a reversal input terminal and a reference voltage to be inputted to a non-reversal input terminal.

* * * * *